US010668320B2

(12) United States Patent
Watterson

(10) Patent No.: US 10,668,320 B2
(45) Date of Patent: Jun. 2, 2020

(54) TREAD BELT LOCKING MECHANISM

(71) Applicant: ICON Health & Fitness, Inc., Logan, UT (US)

(72) Inventor: Scott R. Watterson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 109 days.

(21) Appl. No.: 15/830,316

(22) Filed: Dec. 4, 2017

(65) Prior Publication Data

US 2018/0154209 A1 Jun. 7, 2018

Related U.S. Application Data

(60) Provisional application No. 62/429,970, filed on Dec. 5, 2016.

(51) Int. Cl.

| | |
|---|---|
| ***A63B 22/02*** | (2006.01) |
| ***A63B 21/00*** | (2006.01) |
| ***A63B 21/22*** | (2006.01) |
| ***A63B 24/00*** | (2006.01) |
| ***A63B 23/035*** | (2006.01) |
| ***A63B 71/06*** | (2006.01) |

(52) U.S. Cl.

CPC .... *A63B 22/0257* (2013.01); *A63B 21/00192* (2013.01); *A63B 21/154* (2013.01); *A63B 21/225* (2013.01); *A63B 22/0242* (2013.01); *A63B 23/03566* (2013.01); *A63B 24/0062* (2013.01); *A63B 24/0087* (2013.01); *A63B 71/0622* (2013.01); *A63B 2220/17* (2013.01); *A63B 2220/62* (2013.01); *A63B 2230/06* (2013.01); *A63B 2230/75* (2013.01)

(58) Field of Classification Search

None

See application file for complete search history.

(56) References Cited

U.S. PATENT DOCUMENTS

| | | | |
|---|---|---|---|
| 3,123,646 | A | 3/1964 | Easton |
| 3,579,339 | A | 5/1971 | Chang |
| 3,926,430 | A | 12/1975 | Good, Jr. |
| 4,533,136 | A | 8/1985 | Smith et al. |
| 4,725,057 | A | 2/1988 | Shifferaw |
| 4,968,028 | A | 11/1990 | Wehrell |
| 5,000,442 | A | 1/1991 | Dalebout et al. |
| 5,039,091 | A | 8/1991 | Johnson |

(Continued)

FOREIGN PATENT DOCUMENTS

| | | |
|---|---|---|
| CN | 2172137 y | 7/1994 |
| CN | 2291169 Y | 6/1998 |

(Continued)

OTHER PUBLICATIONS

International Search Report and Written Opinion for PCT/US2017/064523 dated Mar. 21, 2018.

(Continued)

*Primary Examiner* — Jennifer Robertson

(74) *Attorney, Agent, or Firm* — Mashoff Brennan

(57) ABSTRACT

A treadmill may include a deck, a first pulley disposed in a first portion of the deck, a second pulley disposed in a second portion of the deck, a tread belt surrounding the first pulley and the second pulley, and a locking mechanism that selectively prevents the tread belt from moving.

16 Claims, 12 Drawing Sheets

(56) References Cited

U.S. PATENT DOCUMENTS 5,286,243 A 2/1994 Lapcevic
5,292,293 A 3/1994 Schumacher
5,295,928 A 3/1994 Rennex
5,295,935 A 3/1994 Wang
5,299,992 A 4/1994 Wilkinson
5,299,993 A 4/1994 Habing
5,302,162 A 4/1994 Pasero
5,306,221 A 4/1994 Itaru
5,308,075 A 5/1994 Theriault
5,308,304 A 5/1994 Habing
5,310,392 A 5/1994 Lo
5,313,852 A 5/1994 Arena
5,314,390 A 5/1994 Westing et al.
5,314,391 A 5/1994 Potash et al.
5,314,392 A 5/1994 Hawkins et al.
5,314,394 A 5/1994 Ronan
5,318,487 A 6/1994 Golen et al.
5,320,343 A 6/1994 McKinney
5,320,588 A 6/1994 Wanzer et al.
5,320,591 A 6/1994 Harmon et al.
5,320,641 A 6/1994 Riddle
5,324,242 A 6/1994 Lo
5,328,420 A 7/1994 Allen
5,328,422 A 7/1994 Nichols
5,328,429 A 7/1994 Potash et al.
5,330,401 A 7/1994 Walstead
5,330,402 A 7/1994 Johnson
5,334,120 A 8/1994 Rasmussen
5,336,144 A 8/1994 Rodden
5,336,145 A 8/1994 Keiser
5,336,146 A 8/1994 Piaget et al.
5,342,264 A 8/1994 Gordon
5,342,271 A 8/1994 Long
5,344,372 A 9/1994 Hung
5,344,376 A 9/1994 Bostic et al.
5,348,524 A 9/1994 Grant
5,350,344 A 9/1994 Kissel
5,354,252 A 10/1994 Habing
D352,536 S 11/1994 Byrd et al.
5,409,435 A 4/1995 Daniels
5,484,358 A 1/1996 Wang et al.
5,527,245 A 6/1996 Dalebout et al.
5,588,938 A 12/1996 Schnider et al.
5,820,525 A * 10/1998 Riley ..... A63B 22/02 482/54
5,830,113 A 11/1998 Coody et al.
6,027,429 A 2/2000 Daniels
6,030,320 A 2/2000 Stearns et al.
6,030,321 A 2/2000 Fuentes
6,123,649 A 9/2000 Lee et al.
D457,580 S 5/2002 Webber
6,436,008 B1 * 8/2002 Skowronski ..... A63B 22/0023 482/51
6,454,679 B1 9/2002 Radow
6,488,612 B2 12/2002 Sechrest
6,491,610 B1 12/2002 Henn
6,599,223 B2 7/2003 Wang
6,669,607 B2 12/2003 Slawinski
6,699,159 B2 3/2004 Rouse
6,746,371 B1 6/2004 Brown et al.
6,811,520 B2 11/2004 Wu
6,837,830 B2 1/2005 Eldridge
6,857,993 B2 2/2005 Yeh
6,958,032 B1 10/2005 Smith
D511,190 S 11/2005 Panatta
D512,113 S 11/2005 Carter
7,011,326 B1 3/2006 Schroeder et al.
D520,085 S 5/2006 Willardson et al.
7,226,402 B1 6/2007 Joya
D552,193 S 10/2007 Husted et al.
7,311,640 B2 12/2007 Baatz
7,364,538 B2 4/2008 Aucamp
7,381,161 B2 6/2008 Ellis
7,524,272 B2 4/2009 Burck et al.
7,540,828 B2 6/2009 Watterson et al.
7,575,537 B2 8/2009 Ellis
7,584,673 B2 9/2009 Shimizu
7,604,572 B2 10/2009 Stanford
7,641,597 B2 1/2010 Schmidt
7,740,563 B2 6/2010 Dalebout et al.
D633,581 S 3/2011 Thulin
7,942,793 B2 5/2011 Mills et al.
8,029,425 B2 10/2011 Bronston et al.
8,070,657 B2 12/2011 Loach
8,096,926 B1 1/2012 Batca
8,398,529 B2 3/2013 Ellis et al.
8,500,607 B2 8/2013 Vittone et al.
8,517,899 B2 8/2013 Zhou
8,550,964 B2 10/2013 Ish, III et al.
8,764,609 B1 7/2014 Elahmadie
8,808,152 B1 8/2014 Midgett
8,986,165 B2 3/2015 Ashby
9,011,291 B2 4/2015 Birrell
9,044,635 B2 6/2015 Lull
9,170,223 B2 10/2015 Hyun
D746,388 S 12/2015 Hockridge
9,211,433 B2 12/2015 Hall
9,254,409 B2 2/2016 Dalebout et al.
9,393,453 B2 7/2016 Watterson
9,403,047 B2 8/2016 Olson et al.
9,415,257 B2 8/2016 Habing
9,468,793 B2 10/2016 Salmon
9,511,259 B2 12/2016 Mountain
9,539,458 B1 1/2017 Ross
9,616,276 B2 4/2017 Dalebout et al.
9,662,529 B2 5/2017 Miller et al.
9,700,751 B2 7/2017 Verdi
9,757,605 B2 9/2017 Olson et al.
D807,445 S 1/2018 Gettle
9,878,200 B2 1/2018 Edmondson
9,968,816 B2 5/2018 Olson et al.
10,188,890 B2 1/2019 Olson et al.
10,258,828 B2 4/2019 Dalebout
10,279,212 B2 5/2019 Dalebout et al.
10,293,211 B2 5/2019 Watterson et al.
10,388,183 B2 8/2019 Watterson
10,391,361 B2 8/2019 Watterson
10,426,989 B2 10/2019 Dalebout
10,433,612 B2 10/2019 Ashby
10,441,840 B2 10/2019 Dalebout et al.
D868,090 S 12/2019 Cutler et al.
D868,909 S 12/2019 Cutler
10,492,519 B2 12/2019 Capell
10,493,349 B2 12/2019 Watterson
10,500,473 B2 12/2019 Watterson
10,543,395 B2 1/2020 Powell et al.
10,561,877 B2 2/2020 Workman
10,561,893 B2 2/2020 Chatterton
10,561,894 B2 2/2020 Dalebout
10,569,121 B2 2/2020 Watterson
10,569,123 B2 2/2020 Hochstrasser
2002/0013200 A1 1/2002 Sechrest
2002/0025888 A1 2/2002 Germanton
2002/0086779 A1 7/2002 Wilkinson
2003/0032528 A1 2/2003 Wu et al.
2003/0032531 A1 2/2003 Simonson
2003/0032535 A1 2/2003 Wang et al.
2003/0045406 A1 3/2003 Stone
2003/0176261 A1 9/2003 Simonson et al.
2003/0181293 A1 9/2003 Baatz
2004/0043873 A1 3/2004 Wilkinson et al.
2004/0102292 A1 5/2004 Pyles et al.
2004/0176227 A1 9/2004 Endelman
2004/0204294 A2 10/2004 Wilkinson
2005/0049117 A1 3/2005 Rodgers
2005/0130814 A1 6/2005 Nitta et al.
2005/0148445 A1 7/2005 Carle
2005/0164837 A1 7/2005 Anderson et al.
2006/0035755 A1 2/2006 Dalebout et al.
2006/0148622 A1 7/2006 Chen
2006/0240955 A1 10/2006 Pu
2006/0252613 A1 11/2006 Barnes et al.
2007/0123395 A1 5/2007 Ellis
2007/0173392 A1 7/2007 Stanford

(56) References Cited

U.S. PATENT DOCUMENTS

| | | | | |
|---|---|---|---|---|
| 2007/0197346 | A1 | 8/2007 | Seliber | |
| 2007/0232463 | A1 | 10/2007 | Wu | |
| 2007/0287601 | A1* | 12/2007 | Burck | A63B 21/153 482/54 |
| 2008/0051256 | A1 | 2/2008 | Ashby et al. | |
| 2008/0119337 | A1 | 5/2008 | Wilkins et al. | |
| 2009/0036276 | A1 | 2/2009 | Loach | |
| 2010/0255965 | A1 | 10/2010 | Chen | |
| 2011/0009249 | A1 | 1/2011 | Campanaro et al. | |
| 2011/0082013 | A1 | 4/2011 | Bastian | |
| 2012/0065034 | A1 | 3/2012 | Loach | |
| 2012/0088638 | A1 | 4/2012 | Lull | |
| 2012/0277068 | A1 | 11/2012 | Zhou et al. | |
| 2013/0065732 | A1 | 3/2013 | Hopp | |
| 2013/0090216 | A1 | 4/2013 | Jackson | |
| 2013/0109543 | A1 | 5/2013 | Reyes | |
| 2013/0123073 | A1 | 5/2013 | Olson et al. | |
| 2013/0196821 | A1 | 8/2013 | Watterson et al. | |
| 2013/0237374 | A1* | 9/2013 | Ashby | A63B 71/0054 482/4 |
| 2013/0303334 | A1 | 11/2013 | Adhami et al. | |
| 2013/0337981 | A1 | 12/2013 | Habing | |
| 2014/0187389 | A1 | 7/2014 | Berg | |
| 2014/0235409 | A1 | 8/2014 | Salmon et al. | |
| 2014/0357457 | A1 | 12/2014 | Boekema | |
| 2014/0371035 | A1 | 12/2014 | Mortensen et al. | |
| 2015/0038300 | A1 | 2/2015 | Forhan et al. | |
| 2015/0182779 | A1 | 7/2015 | Dalebout | |
| 2015/0352396 | A1* | 12/2015 | Dalebout | A63B 21/0051 482/54 |
| 2017/0266481 | A1 | 9/2017 | Dalebout | |
| 2017/0266533 | A1 | 9/2017 | Dalebout | |
| 2018/0117385 | A1* | 5/2018 | Watterson | A63B 23/0405 |
| 2018/0154205 | A1* | 6/2018 | Watterson | A63B 71/0622 |
| 2018/0154209 | A1 | 6/2018 | Watterson | |
| 2019/0054344 | A1* | 2/2019 | Athey | A63B 22/02 |
| 2019/0151698 | A1 | 5/2019 | Olson et al. | |
| 2019/0232112 | A1 | 8/2019 | Dalebout | |
| 2019/0269958 | A1 | 9/2019 | Dalebout et al. | |
| 2019/0376585 | A1 | 12/2019 | Buchanan | |
| 2020/0009417 | A1 | 1/2020 | Dalebout | |
| 2020/0016459 | A1 | 1/2020 | Smith | |

FOREIGN PATENT DOCUMENTS

| | | | |
|---|---|---|---|
| CN | 2291169 | | 9/1998 |
| CN | 101784308 | | 11/2001 |
| CN | 1658929 | | 8/2005 |
| CN | 1708333 | | 12/2005 |
| CN | 2841072 | | 11/2006 |
| CN | 2841072 | Y | 11/2006 |
| CN | 201516258 | | 6/2010 |
| CN | 201410258 | y | 2/2014 |
| CN | 103801048 | | 5/2014 |
| CN | 10488413 | | 9/2015 |
| CN | 105848733 | | 8/2016 |
| CN | 104884133 | B | 2/2018 |
| CN | 106470739 | B | 6/2019 |
| CN | 110035801 | | 7/2019 |
| EP | 1188460 | | 3/2002 |
| EP | 2969058 | | 1/2016 |
| EP | 3086865 | A1 | 11/2016 |
| EP | 3086865 | A1 | 1/2020 |
| JP | 2013543749 | | 12/2013 |
| SU | 1533710 | | 1/1990 |
| TW | M464203 | | 11/2013 |
| TW | M495871 | | 2/2015 |
| TW | 201601802 | | 1/2016 |
| TW | 201821129 | A | 6/2018 |
| TW | 201821130 | A | 6/2018 |
| TW | 201601802 | A | 12/2018 |
| WO | 1989002217 | | 3/1989 |
| WO | 1997006859 | | 2/1997 |
| WO | 2002053234 | A1 | 7/2002 |
| WO | 2007015096 | A3 | 2/2007 |
| WO | 2014153158 | | 9/2014 |
| WO | 2015/100429 | | 7/2015 |
| WO | 2015191445 | | 12/2015 |
| WO | 2018106598 | | 6/2018 |
| WO | 2018106603 | | 6/2018 |

OTHER PUBLICATIONS

English translation and original of office action and search report for Taiwan patent application No. 106138351 dated Aug. 7, 2018.

U.S. Appl. No. 61/920,834, filed Dec. 26, 2013, titled "Magnetic Resistance Mechanism in a Cable Machine", 31 pages.

Exxentric, Movie Archives, obtained from the Wayback Machine for http://exxentric.com/movies/ accessed for Aug. 19, 2015.

International Search Report & Written Opinion for PCT Application No. PCT/US2014/072390, dated Mar. 27, 2015, 9 pages.

Supplemental European Search Report for European Application No. 14874303, dated May 10, 2017, 6 pages.

*Nautilus, Inc.* v. *Icon Health & Fitness, Inc.*, Civil Case No. IPR2017-01363, Petition for Inter Partes Review of U.S. Pat. No. 9,403,047, filed May 5, 2017; 76 pages (paper 2).

*Nautilus, Inc.* v. *Icon Health & Fitness, Inc.*, Civil Case No. IPR2017-01363, Olson, U.S. Pat. No. 9,403,047, 16 pages, (Petition EX. 1001).

*Nautilus, Inc.* v. *Icon Health & Fitness, Inc.*, Civil Case No. IPR2017-01363, Sleamaker, U.S. Pat. No. 5,354,251, 14 pages, (Petition EX. 1002).

*Nautilus, Inc.* v. *Icon Health & Fitness, Inc.*, Civil Case No. IPR2017-01363, Hanoun, U.S. Publication No. 2007-0232452, 28 pages, (Petition EX. 1003).

*Nautilus, Inc.* v. *Icon Health & Fitness, Inc.*, Civil Case No. IPR2017-01363, Six-Pak, Printed Publication TuffStuff Fitness Six-Pak Trainer Owner's Manual, 19 pages, (Petition EX 1004).

*Nautilus, Inc.* v. *Icon Health & Fitness, Inc.*, Civil Case No. IPR2017-01363, Ehrenfried, U.S. Pat. No. 5,738,611, 19 pages, (Petition EX. 1005).

*Nautilus, Inc.* v. *Icon Health & Fitness, Inc.*, Civil Case No. IPR2017-01363, Kleinman, International Publication No. WO2008/152627, 65 pages, (Petition EX. 1006).

*Nautilus, Inc.* v. *Icon Health & Fitness, Inc.*, Civil Case No. IPR2017-01363, Declaration of Lee Rawls, (Petition EX. 1007).

*Nautilus, Inc.* v. *Icon Health & Fitness, Inc.*, Civil Case No. IPR2017-01363, U.S. Pat. No. 9,403,047 File history, 130 pages, (Petition EX. 1008).

*Nautilus, Inc.* v. *Icon Health & Fitness, Inc.*, Civil Case No. IPR2017-01363, U.S. Appl. No. 61/920,834, 38 pages, (Petition EX. 1009).

*Nautilus, Inc.* v. *Icon Health & Fitness, Inc.*, Civil Case No. IPR2017-01363, Declaration of Christopher Butler, 26 pages, (Petition EX. 1010).

*Nautilus, Inc.* v. *Icon Health & Fitness, Inc.*, Civil Case No. IPR2017-01363, Petitioner's Power of Attorney, filed May 5, 2017, 2 pages (paper 2).

*Nautilus, Inc.* v. *Icon Health & Fitness, Inc.*, Civil Case No. IPR2017-01363, Mandatory Notice to Patent Owner, filed May 19, 2017, 4 pages (paper 3).

*Nautilus, Inc.* v. *Icon Health & Fitness, Inc.*, Civil Case No. IPR2017-01363, Power of Attorney, filed May 19, 2017, 3 pages (paper 4).

*Nautilus, Inc.* v. *Icon Health & Fitness, Inc.*, Civil Case No. IPR2017-01363, Notice of Accord Filing Date, filed Jun. 9, 2017, 5 pages (paper 5).

U.S. Appl. No. 61/786,007, filed Mar. 14, 2013, titled "Strength Training Apparatus with Flywheel and Related Methods", 28 pages.

U.S. Appl. No. 62/009,607, filed Jun. 9, 2014, titled "Cable System Incorporated into a Treadmill", 32 pages.

International Search Report & Written Opinion for PCT Application No. PCT/US2014/029353, dated Aug. 4, 2014, 9 pages.

Supplemental European Search Report for European Application No. 14768130, dated Oct. 11, 2016, 9 pages.

U.S. Appl. No. 15/472,954, filed Mar. 29, 2017, titled "Strength Training Apparatus with Flywheel and Related Methods", 22 pages.

(56) References Cited

OTHER PUBLICATIONS

U.S. Appl. No. 15/976,496, filed May 10, 2018, titled "Magnetic Resistance Mechanism in a Cable Machine", 36 pages.
*Nautilus, Inc.* v. *Icon Health & Fitness, Inc.*, Civil Case No. IPR2017-01407, Petition for Inter Partes Review of U.S. Pat. No. 9,616,276 (Claims 1-4, 7-10), filed May 5, 2017.
*Nautilus, Inc.* v. *Icon Health & Fitness, Inc.*, Civil Case No. IPR2017-01407, Dalebout et al., U.S. Pat. No. 9,616,276, (Petition EX. 1001).
*Nautilus, Inc.* v. *Icon Health & Fitness, Inc.*, Civil Case No. IPR2017-01407, Wu, U.S. Publication No. 20030171192, (Petition EX. 1002).
*Nautilus, Inc.* v. *Icon Health & Fitness, Inc.*, Civil Case No. IPR2017-01407, Webb, U.S. Publication No. 20030017918, (Petition EX. 1003).
*Nautilus, Inc.* v. *Icon Health & Fitness, Inc.*, Civil Case No. IPR2017-01407, Watson, U.S. Publication No. 20060234840, (Petition EX. 1004).
*Nautilus, Inc.* v. *Icon Health & Fitness, Inc.*, Civil Case No. IPR2017-01407, Jones, U.S. Pat. No. 4,798,378, (Petition EX. 1005).
*Nautilus, Inc.* v. *Icon Health & Fitness, Inc.*, Civil Case No. IPR2017-01407, Zhou et al., U.S. Pat. No. 8,517,899, (Petition EX. 1006).
*Nautilus, Inc.* v. *Icon Health & Fitness, Inc.*, Civil Case No. IPR2017-01407, Loach, U.S. Publication No. WO2007015096, (Petition EX. 1007).
*Nautilus, Inc.* v. *Icon Health & Fitness, Inc.*, Civil Case No. IPR2017-01407, Rawls Declaration, Part 1 & 2, (Petition EX. 1008).
*Nautilus, Inc.* v. *Icon Health & Fitness, Inc.*, Civil Case No. IPR2017-01407, U.S. Pat. No. 9,616,276 File History, (Petition EX. 1009).
*Nautilus, Inc.* v. *Icon Health & Fitness, Inc.*, Civil Case No. IPR2017-01407, U.S. Appl. No. 61/786,007 File History, (Petition EX. 1010).
*Nautilus, Inc.* v. *Icon Health & Fitness, Inc.*, Civil Case No. IPR2017-01407, Sawicky, U.S. Pat. No. 5,042,798, (Petition EX. 1011).
*Nautilus, Inc.* v. *Icon Health & Fitness, Inc.*, Civil Case No. IPR2017-01407, Petitioner's Power of Attorney, filed May 5, 2017.
*Nautilus, Inc.* v. *Icon Health & Fitness, Inc.*, Civil Case No. IPR2017-01407, Mandatory Notice to Patent Owner, filed May 19, 2017.
*Nautilus, Inc.* v. *Icon Health & Fitness, Inc.*, Civil Case No. IPR2017-01407, Power of Attorney, filed May 19, 2017.
*Nautilus, Inc.* v. *Icon Health & Fitness, Inc.*, Civil Case No. IPR2017-01407, Notice of Accord Filing Date, filed Jun. 6, 2017.
*Nautilus, Inc.* v. *Icon Health & Fitness, Inc.*, Civil Case No. IPR2017-01408, Petition for Inter Partes Review of U.S. Pat. No. 9,616,276 (Claims 1-20) filed May 5, 2017.
*Nautilus, Inc.* v. *Icon Health & Fitness, Inc.*, Civil Case No. IPR2017-01408, Dalebout et al., U.S. Pat. No. 9,616,276, (Petition EX. 1001).
*Nautilus, Inc.* v. *Icon Health & Fitness, Inc.*, Civil Case No. IPR2017-01408, Wu, U.S. Publication No. 20030171192, (Petition EX. 1002).
*Nautilus, Inc.* v. *Icon Health & Fitness, Inc.*, Civil Case No. IPR2017-01408, Webb, U.S. Publication No. 20030017918, (Petition EX. 1003).
*Nautilus, Inc.* v. *Icon Health & Fitness, Inc.*, Civil Case No. IPR2017-01408, Watson, U.S. Publication No. 20060234840, (Petition EX. 1004).
*Nautilus, Inc.* v. *Icon Health & Fitness, Inc.*, Civil Case No. IPR2017-01408, Jones, U.S. Pat. No. 4,798,378, (Petition EX. 1005).
*Nautilus, Inc.* v. *Icon Health & Fitness, Inc.*, Civil Case No. IPR2017-01408, Zhou et al., U.S. Pat. No. 8,517,899, (Petition EX. 1006).
*Nautilus, Inc.* v. *Icon Health & Fitness, Inc.*, Civil Case No. IPR2017-01408, Loach, U.S. Publication No. WO2007015096, (Petition EX. 1007).
*Nautilus, Inc.* v. *Icon Health & Fitness, Inc.*, Civil Case No. IPR2017-01408, Rawls Declaration, Part 1 & 2, (Petition EX. 1008).
*Nautilus, Inc.* v. *Icon Health & Fitness, Inc.*, Civil Case No. IPR2017-01408, U.S. Pat. No. 9,616,276 File History, (Petition EX. 1009).
*Nautilus, Inc.* v. *Icon Health & Fitness, Inc.*, Civil Case No. IPR2017-01408, U.S. Appl. No. 61/786,007 File History, (Petition EX. 1010).
*Nautilus, Inc.* v. *Icon Health & Fitness, Inc.*, Civil Case No. IPR2017-01408, Sawicky, U.S. Pat. No. 5,042,798, (Petition EX. 1011).
*Nautilus, Inc.* v. *Icon Health & Fitness, Inc.*, Civil Case No. IPR2017-01408, Petitioner's Power of Attorney, filed May 5, 2017.
*Nautilus, Inc.* v. *Icon Health & Fitness, Inc.*, Civil Case No. IPR2017-01408, Mandatory Notice to Patent Owner, filed May 19, 2017.
*Nautilus, Inc.* v. *Icon Health & Fitness, Inc.*, Civil Case No. IPR2017-01408, Power of Attorney, filed May 19, 2017.
*Nautilus, Inc.* v. *Icon Health & Fitness, Inc.*, Civil Case No. IPR2017-01408, Notice of Accord Filing Date, filed Jun. 6, 2017.
Chinese Office Action for Chinese Patent Application No. 201480003701.9 dated Apr. 6, 2016.
Chinese Search Report for Chinese Patent Application No. 2014800708329 dated Jun. 2, 2017.
*Nautilus, Inc.* v. *Icon Health & Fitness, Inc.*, Civil Case No. IPR2017-01363, Declaration of Tyson Hottinger in Support of Motion for Admission PRO HAC VICE, filed Feb. 1, 2018 (Ex 2001).
*Nautilus, Inc.* v. *Icon Health & Fitness, Inc.*, Civil Case No. IPR2017-01363, Transcript of Deposition of R. Lee Rawls, filed Mar. 5, 2018 (Ex 2002).
*Nautilus, Inc.* v. *Icon Health & Fitness, Inc.*, Civil Case No. IPR2017-01363, Order Conduct of Proceedings, filed May 7, 2018 (Paper 20).
*Nautilus, Inc.* v. *Icon Health & Fitness, Inc.*, Civil Case No. IPR2017-01407, Decision Institution of Inter Partes Review, filed Dec. 4, 2017 (Paper 6).
*Nautilus, Inc.* v. *Icon Health & Fitness, Inc.*, Civil Case No. IPR2017-01407, Scheduling Order, filed Dec. 4, 2017 (Paper 7).
*Nautilus, Inc.* v. *Icon Health & Fitness, Inc.*, Civil Case No. IPR2017-01407, Order, filed Jan. 19, 2018 (Paper 8).
*Nautilus, Inc.* v. *Icon Health & Fitness, Inc.*, Civil Case No. IPR2017-01407, Patent Owner's Notice of Deposition of R. Lee Rawls, filed Jan. 19, 2018 (Paper 9).
*Nautilus, Inc.* v. *Icon Health & Fitness, Inc.*, Civil Case No. IPR2017-01407, Unopposed Motion for Pro Hac Vice Admission of Tyson Hottinger, filed Feb. 1, 2018 (Paper 10).
*Nautilus, Inc.* v. *Icon Health & Fitness, Inc.*, Civil Case No. IPR2017-01407, Patent Owner's Current Exhibit List, filed Feb. 1, 2018 (Paper 11).
*Nautilus, Inc.* v. *Icon Health & Fitness, Inc.*, Civil Case No. IPR2017-01407, Patent Owner's Updated Notice of Deposition of R. Lee Rawls, filed Feb. 1, 2018 (Paper 12).
*Nautilus, Inc.* v. *Icon Health & Fitness, Inc.*, Civil Case No. IPR2017-01407, Order Granting Motion of Pro Hac Vice Admission of Mr. Hottinger, filed Feb. 12, 2018 (Paper 13).
*Nautilus, Inc.* v. *Icon Health & Fitness, Inc.*, Civil Case No. IPR2017-01407, Petitioner's Updated Mandatory Notices, filed Feb. 20, 2018 (Paper 14).
*Nautilus, Inc.* v. *Icon Health & Fitness, Inc.*, Civil Case No. IPR2017-01407, Petitioner's Updated Power of Attorney, filed Feb. 20, 2018 (Paper 15).
*Nautilus, Inc.* v. *Icon Health & Fitness, Inc.*, Civil Case No. IPR2017-01407, Patent Owner's Motion to Amend, filed Mar. 5, 2018 (Paper 16).
*Nautilus, Inc.* v. *Icon Health & Fitness, Inc.*, Civil Case No. IPR2017-01407, Current Exhibit List of Patent Owner, filed Mar. 5, 2018 (Paper 17).

(56) References Cited

OTHER PUBLICATIONS

*Nautilus, Inc.* v. *Icon Health & Fitness, Inc.*, Civil Case No. IPR2017-01407, Order Conduct of Proceedings 37 C.F.R. Sec 42.5, filed Apr. 27, 2018 (Paper 18).
*Nautilus, Inc.* v. *Icon Health & Fitness, Inc.*, Civil Case No. IPR2017-01407, Order Conduct of Proceedings 37 C.F.R. Sec 42.5, filed May 7, 2018 (Paper 19).
*Nautilus, Inc.* v. *Icon Health & Fitness, Inc.*, Civil Case No. IPR2017-01407, Declaration of Tyson Hottinger in Support of Motion for Admission PRO HAC VICE, (Patent Owner EX. 2001).
*Nautilus, Inc.* v. *Icon Health & Fitness, Inc.*, Civil Case No. IPR2017-01407, Claim Listing of Proposed Substitute Claims for Patent Owner Motion to Amend, (Patent Owner EX. 2002).
*Nautilus, Inc.* v. *Icon Health & Fitness, Inc.*, Civil Case No. IPR2017-01407, Specification of U.S. Pat. No. 9,616,276, (Patent Owner EX. 2003).
*Nautilus, Inc.* v. *Icon Health & Fitness, Inc.*, Civil Case No. IPR2017-01407, Drawings of U.S. Pat. No. 9,616,276, (Patent Owner EX. 2004).
*Nautilus, Inc.* v. *Icon Health & Fitness, Inc.*, Civil Case No. IPR2017-01407, Specification of U.S. Pat. No. 9,254,409 (Patent Owner EX. 2005).
*Nautilus, Inc.* v. *Icon Health & Fitness, Inc.*, Civil Case No. IPR2017-01407, Drawings of U.S. Pat. No. 9,254,409 (Patent Owner EX. 2006).
*Nautilus, Inc.* v. *Icon Health & Fitness, Inc.*, Civil Case No. IPR2017-01407, Provisional Patent Specification of U.S. Appl.No. 61/786,007, (Patent Owner EX. 2007).
*Nautilus, Inc.* v. *Icon Health & Fitness, Inc.*, Civil Case No. IPR2017-01407, Provisional Patent Drawings of U.S. Appl. No. 61/786,007, (Patent Owner EX. 2008).
*Nautilus, Inc.* v. *Icon Health & Fitness, Inc.*, Civil Case No. IPR2017-01407, Specification of U.S. Appl. No. 13/754,361 (Patent Owner EX. 2009).
*Nautilus, Inc.* v. *Icon Health & Fitness, Inc.*, Civil Case No. IPR2017-01407, Drawings of U.S. Appl. No. 13/754,361 (Patent Owner EX. 2010).
*Nautilus, Inc.* v. *Icon Health & Fitness, Inc.*, Civil Case No. IPR2017-01407, Webster Dictionary p. 2211 (Merriam-Webster, Inc. 1961, 2002) (EX. 3001).
*Nautilus, Inc.* v. *Icon Health & Fitness, Inc.*, Civil Case No. IPR2017-01408, Patent Owner Preliminary Response to Petition, filed Sep. 5, 2017 (Paper 6).
*Nautilus, Inc.* v. *Icon Health & Fitness, Inc.*, Civil Case No. IPR2017-01408, Decision Institution of Inter Partes Review, filed Dec. 4, 2017 (Paper 7).
*Nautilus, Inc.* v. *Icon Health & Fitness, Inc.*, Civil Case No. IPR2017-01408, Scheduling Order, filed Dec. 4, 2017 (Paper 8).
*Nautilus, Inc.* v. *Icon Health & Fitness, Inc.*, Civil Case No. IPR2017-01408, Order Conduct of Proceeding, filed Jan. 19, 2018 (Paper 9).
*Nautilus, Inc.* v. *Icon Health & Fitness, Inc.*, Civil Case No. IPR2017-01408, Patent Owner's Notice of Deposition of R. Lee Rawls, filed Jan. 19, 2018 (Paper 10).
*Nautilus, Inc.* v. *Icon Health & Fitness, Inc.*, Civil Case No. IPR2017-01408, Unopposed Motion for Pro Hac Vice Admission of Tyson Hottinger, filed Feb. 1, 2018 (Paper 11).
*Nautilus, Inc.* v. *Icon Health & Fitness, Inc.*, Civil Case No. IPR2017-01408, Current Exhibit List for Patent Owner, filed Feb. 1, 2018 (Paper 12).
*Nautilus, Inc.* v. *Icon Health & Fitness, Inc.*, Civil Case No. IPR2017-01408, Patent Owner's Updated Notice of Deposition of R. Lee Rawls, Feb. 1, 2018 (Paper 13).
*Nautilus, Inc.* v. *Icon Health & Fitness, Inc.*, Civil Case No. IPR2017-01408, Order Granting Motion for PRO HAC VICE Admission, filed Feb. 12, 2018 (Paper 14).
*Nautilus, Inc.* v. *Icon Health & Fitness, Inc.*, Civil Case No. IPR2017-01408, Petitioner's Updated Mandatory Notices, filed Feb. 20, 2018 (Paper 15).
*Nautilus, Inc.* v. *Icon Health & Fitness, Inc.*, Civil Case No. IPR2017-01408, Petitioner's Updated Power of Attorney, filed Feb. 20, 2018 (Paper 16).
*Nautilus, Inc.* v. *Icon Health & Fitness, Inc.*, Civil Case No. IPR2017-01408, Patent Owners Motion to Amend, filed Mar. 5, 2018 (Paper 17).
*Nautilus, Inc.* v. *Icon Health & Fitness, Inc.*, Civil Case No. IPR2017-01408, Current Exhibit List of Patent Owner, filed Mar. 5, 2018 (Paper 18).
*Nautilus, Inc.* v. *Icon Health & Fitness, Inc.*, Civil Case No. IPR2017-01408, Order Conduct of Proceedings, filed Apr. 27, 2018 (Paper 19).
*Nautilus, Inc.* v. *Icon Health & Fitness, Inc.*, Civil Case No. IPR2017-01408, Order Conduct of Proceedings, filed May 7, 2018 (Paper 20).
*Nautilus, Inc.* v. *Icon Health & Fitness, Inc.*, Civil Case No. IPR2017-01408, Declaration of Tyson Hottinger in Support of Motion for Admission PRO HAC VICE, (Patent Owner EX. 2001).
*Nautilus, Inc.* v. *Icon Health & Fitness, Inc.*, Civil Case No. IPR2017-01408, Claim Listing of Proposed Substitute Claims for Patent Owner Motion to Amend, (Patent Owner EX. 2002).
*Nautilus, Inc.* v. *Icon Health & Fitness, Inc.*, Civil Case No. IPR2017-01408, Specification of U.S. Appl. No. 15/019,088, (Patent Owner EX. 2003).
*Nautilus, Inc.* v. *Icon Health & Fitness, Inc.*, Civil Case No. IPR2017-01408, Drawings of U.S. Appl. No. 15/019,088, (Patent Owner EX. 2004).
*Nautilus, Inc.* v. *Icon Health & Fitness, Inc.*, Civil Case No. IPR2017-01408, Specification of U.S. Appl. No. 14/213,793, (Patent Owner EX. 2005).
*Nautilus, Inc.* v. *Icon Health & Fitness, Inc.*, Civil Case No. IPR2017-01408, Drawings of U.S. Appl. No. 14/213,793, (Patent Owner EX. 2006).
*Nautilus, Inc.* v. *Icon Health & Fitness, Inc.*, Civil Case No. IPR2017-01408, Specification of U.S. Appl. No. 61/786,007, (Patent Owner EX. 2007).
*Nautilus, Inc.* v. *Icon Health & Fitness, Inc.*, Civil Case No. IPR2017-01408, Drawings of U.S. Appl. No. 61/786,007, (Patent Owner EX. 2008).
*Nautilus, Inc.* v. *Icon Health & Fitness, Inc.*, Civil Case No. IPR2017-01408, Specification of U.S. Appl. No. 13/754,361, (Patent Owner EX. 2009).
*Nautilus, Inc.* v. *Icon Health & Fitness, Inc.*, Civil Case No. IPR2017-01408, Drawings of U.S. Appl. No. 13/754,361, (Patent Owner EX. 2010).
*Nautilus, Inc.* v. *Icon Health & Fitness, Inc.*, Civil Case No. IPR2017-01408, Webster Dictionary p. 2211 (Merriam-Webster, Inc. 1961, 2002) (EX. 3001).
*Nautilus, Inc.* v. *Icon Health & Fitness, Inc.*, Civil Case No. IPR2017-01363, Petitioner's Reply in Support of Petition for Inter Partes Review; filed Jun. 4, 2018; 18 pages (paper 21).
*Nautilus, Inc.* v. *Icon Health & Fitness, Inc.*, Civil Case No. IPR2017-01363, Petitioner's Motion for Pro Hac Vice Admission, filed Jun. 6, 2018; 5 pages (paper 22).
*Nautilus, Inc.* v. *Icon Health & Fitness, Inc.*, Civil Case No. IPR2017-01363; Affidavit of Lane M. Polozola in support of Petitioner's Motion of Pro Hac Vice Admission Under 37 C.F.R. 42.10(c), filed Jun. 6, 2018, 4 pages (exhibit 1011).
*Nautilus, Inc.* v. *Icon Health & Fitness, Inc.*, Civil Case No. IPR2017-01363, Order granting Motion for Pro Hac Vice Admission—37 C.F.R. 42.10(c), filed Jun. 14, 2018; 4 pages (paper 23).
*Nautilus, Inc.* v. *Icon Health & Fitness, Inc.*, Civil Case No. IPR2017-01363, Petitioner's Updated Mandatory Notices, filed Jun. 20, 2018; 4 pages (paper 24).
*Nautilus, Inc.* v. *Icon Health & Fitness, Inc.*, Civil Case No. IPR2017-01363, Petitioner's Updated Power of Attorney, filed Jun. 20, 2018; 3 pages (paper 25).
*Nautilus, Inc.* v. *Icon Health & Fitness, Inc.*, Civil Case No. IPR2017-01363, Petitioner's Request for Oral Argument, filed Jul. 25, 2018; 4 pages; (paper 26).
*Nautilus, Inc.* v. *Icon Health & Fitness, Inc.*, Civil Case No. IPR2017-01363, Patent Owner's Request for Oral Argument, filed Jul. 25, 2018; 4 pages (paper 27).

(56) References Cited

OTHER PUBLICATIONS

*Nautilus, Inc.* v. *Icon Health & Fitness, Inc.*, Civil Case No. IPR2017-01363, Order 37 C.F.R. 42.70, filed Aug. 14, 2018, 5 pages (paper 28).
*Nautilus, Inc.* v. *Icon Health & Fitness, Inc.*, Civil Case No. IPR2017-01363, Current Exhibit List of Patent Owner, filed Aug. 24, 2018, 3 pages (paper 29).
*Nautilus, Inc.* v. *Icon Health & Fitness, Inc.*, Civil Case No. IPR2017-01363, Order Conduct of Proceedings 37 C.F.R. 42.5, filed Aug. 24, 2018, 4 pages (paper 30).
*Nautilus, Inc.* v. *Icon Health & Fitness, Inc.*, Civil Case No. IPR2017-01363, Petitioner's Updated Exhibit List, filed Aug. 24, 2018, 4 pages (paper 31).
*Nautilus, Inc.* v. *Icon Health & Fitness, Inc.*, Civil Case No. IPR2017-01363; Petitioner's Oral Argument Demonstrative Exhibits, filed Aug. 24, 2018, 31 pages (exhibit 1012).
*Nautilus, Inc.* v. *Icon Health & Fitness, Inc.*, Civil Case No. IPR2017-01363; Patent Owner Demonstrative Exhibits; filed Aug. 24, 2018, 10 pages (exhibit 2003).
*Nautilus, Inc.* v. *Icon Health & Fitness, Inc.*, Civil Case No. IPR2017-01407, Petitioner's Motion for Pro Hac Vice Admission, filed Jun. 6, 2018, 5 pages (paper 21).
*Nautilus, Inc.* v. *Icon Health & Fitness, Inc.*, Civil Case No. IPR2017-01407, Patent Owner's Objections to Evidence, filed Jun. 7, 2018, 5 pages (paper 22).
*Nautilus, Inc.* v. *Icon Health & Fitness, Inc.*, Civil Case No. IPR2017-01407, Patent Owner's Notice of Deposition of Christopher Cox, filed Jun. 13, 2018, 3 pages (paper 23).
*Nautilus, Inc.* v. *Icon Health & Fitness, Inc.*, Civil Case No. IPR2017-01407, Order—Granting Motion for Pro Hac Vice Admission, filed Jun. 14, 2018, 4 pages (paper 24).
*Nautilus, Inc.* v. *Icon Health & Fitness, Inc.*, Civil Case No. IPR2017-01407, Petitioner's Updated Mandatory Notices, filed Jun. 20, 2018, 4 pages, (paper 25).
*Nautilus, Inc.* v. *Icon Health & Fitness, Inc.*, Civil Case No. IPR2017-01407, Petitioner's Updated Power of Attorney, filed Jun. 20, 2018, 3 pages, (paper 26).
*Nautilus, Inc.* v. *Icon Health & Fitness, Inc.*, Civil Case No. IPR2017-01407, Patent Owner's Reply to Petitioners Opposition to Motions to Amend, filed Jul. 5, 2018, 28 pages, (paper 27).
*Nautilus, Inc.* v. *Icon Health & Fitness, Inc.*, Civil Case No. IPR2017-01407, Current Exhibit List for Patent Owner, filed Jul. 5, 2018, 4 pages, (paper 28).
*Nautilus, Inc.* v. *Icon Health & Fitness, Inc.*, Civil Case No. IPR2017-01407, Patent Owners Updated Mandatory Notices, filed Jul. 5, 2018, 4 pages, (paper 29).
*Nautilus, Inc.* v. *Icon Health & Fitness, Inc.*, Civil Case No. IPR2017-01407, Petitioner's Notice of Deposition Scott Ganaja, filed Jul. 11, 2018, 3 pages (paper 30).
*Nautilus, Inc.* v. *Icon Health & Fitness, Inc.*, Civil Case No. IPR2017-01407, Joint Notice of Stipulation to Modify Scheduling Order, filed Jul. 12, 2018, 3 pages, (paper 31).
*Nautilus, Inc.* v. *Icon Health & Fitness, Inc.*, Civil Case No. IPR2017-01407, Petitioner's Objections to Evidence, filed Jul. 12, 2018, 4 pages (paper 32).
*Nautilus, Inc.* v. *Icon Health & Fitness, Inc.*, Civil Case No. IPR2017-01407, Petitioner's Amended Notice of Deposition Scott Ganaja, filed Jul. 12, 2018, 3 pages (paper 33).
*Nautilus, Inc.* v. *Icon Health & Fitness, Inc.*, Civil Case No. IPR2017-01407, Order Conduct of Proceeding 37 C.F.R. 42.5, filed Jul. 20, 2018, 5 pages, (paper 34).
*Nautilus, Inc.* v. *Icon Health & Fitness, Inc.*, Civil Case No. IPR2017-01407, Petitioner's Sur-Reply ISO Opposition to Motions to Amend, filed Aug. 1, 2018, 19 pages, (paper 35).
*Nautilus, Inc.* v. *Icon Health & Fitness, Inc.*, Civil Case No. IPR2017-01407, Joint Notice of Stipulation to Modify Scheduling Order, filed Aug. 3, 2018, 3 pages (paper 36).
*Nautilus, Inc.* v. *Icon Health & Fitness, Inc.*, Civil Case No. IPR2017-01407, Order Conduct of the Proceeding, filed Aug. 7, 2018, 4 pages (paper 37).
*Nautilus, Inc.* v. *Icon Health & Fitness, Inc.*, Civil Case No. IPR2017-01407, Patent Owner's Objections to Petitioners Sur Reply, filed Aug. 8, 2018, 5 pages (paper 38).
*Nautilus, Inc.* v. *Icon Health & Fitness, Inc.*, Civil Case No. IPR2017-01407, Patent Owner's Request for Oral Argument, filed Aug. 10, 2018, 4 pages, (paper 39).
*Nautilus, Inc.* v. *Icon Health & Fitness, Inc.*, Civil Case No. IPR2017-01407, Petitioner's Request for Oral Argument, filed Aug. 10, 2018, 4 pages, (paper 40).
*Nautilus, Inc.* v. *Icon Health & Fitness, Inc.*, Civil Case No. IPR2017-01407, Patent Owner's Motion to Exclude Evidence, filed Aug. 10, 2018, 11 pages (paper 41).
*Nautilus, Inc.* v. *Icon Health & Fitness, Inc.*, Civil Case No. IPR2017-01407, Order 37 C.F.R. 42.70, filed Aug. 14, 2018, 5 pages (paper 42).
*Nautilus, Inc.* v. *Icon Health & Fitness, Inc.*, Civil Case No. IPR2017-01407, Petitioner's Opposition to Patent Owner's Motion to Exclude, filed Aug. 16, 2018, 18 pages (paper 44).
*Nautilus, Inc.* v. *Icon Health & Fitness, Inc.*, Civil Case No. IPR2017-01407, Patent Owner's Reply in support of Motion to Exclude, filed Aug. 22, 2018, 8 pages, (paper 45).
*Nautilus, Inc.* v. *Icon Health & Fitness, Inc.*, Civil Case No. IPR2017-01407, Current Exhibit List of Patent Owner, filed Aug. 24, 2018, 4 pages (paper 46).
*Nautilus, Inc.* v. *Icon Health & Fitness, Inc.*, Civil Case No. IPR2017-01407, Order re PO Sur-Rebuttal at Hearing, filed Aug. 24, 2018, 4 pages (paper 47).
*Nautilus, Inc.* v. *Icon Health & Fitness, Inc.*, Civil Case No. IPR2017-01407, Exhibit 1012—U.S. Pat. No. 8,585,561 (Watt), filed Jun. 4, 2018, 32 pages.
*Nautilus, Inc.* v. *Icon Health & Fitness, Inc.*, Civil Case No. IPR2017-01407, Exhibit 1013—U.S. Pat. No. 9,044,635 (Lull), filed Jun. 4, 2018, 21 pages.
*Nautilus, Inc.* v. *Icon Health & Fitness, Inc.*, Civil Case No. IPR2017-01407, Exhibit 1014—U.S. Pat. No. 7,740,563 (Dalebout), filed Jun. 4, 2018, 31 pages.
*Nautilus, Inc.* v. *Icon Health & Fitness, Inc.*, Civil Case No. IPR2017-01407, Exhibit 1015—US20020055418A1 (Pyles), filed Jun. 4, 2018, 9 pages.
*Nautilus, Inc.* v. *Icon Health & Fitness, Inc.*, Civil Case No. IPR2017-01407, Exhibit 1016—US20120258433A1 (Hope), filed Jun. 4, 2018, 51 pages.
*Nautilus, Inc.* v. *Icon Health & Fitness, Inc.*, Civil Case No. IPR2017-01407, Exhibit 1017—U.S. Pat. No. 7,771,320 (Riley), filed Jun. 4, 2018, 44 pages.
*Nautilus, Inc.* v. *Icon Health & Fitness, Inc.*, Civil Case No. IPR2017-01407, Exhibit 1018—Declaration of Christopher Cox in Support of Petitioners Oppositions to Patent Owners Motions to Amend, filed Jun. 4, 2018, 739 pages.
*Nautilus, Inc.* v. *Icon Health & Fitness, Inc.*, Civil Case No. IPR2017-01407, Exhibit 1019—Affidavit of Lane M. Polozola in Support of Petitioners Motion for Pro Hac Vice Admission, filed Jun. 6, 2018, 4 pages.
*Nautilus, Inc.* v. *Icon Health & Fitness, Inc.*, Civil Case No. IPR2017-01407, Exhibit 1020—S. Ganaja Depo Transcript, filed Aug. 1, 2018, 58 pages.
*Nautilus, Inc.* v. *Icon Health & Fitness, Inc.*, Civil Case No. IPR2017-01407, Exhibit 1021—Petitioner's Demonstrative Exhibits, filed Aug. 24, 2018, 92 pages.
*Nautilus, Inc.* v. *Icon Health & Fitness, Inc.*, Civil Case No. IPR2017-01407, Exhibit 2011—Declaration of Scott Ganaja in Support of Patent Owner's Reply to Petitioners Opposition to Patent Owners Motion to Amend, filed Jul. 5, 2018, 42 pages.
*Nautilus, Inc.* v. *Icon Health & Fitness, Inc.*, Civil Case No. IPR2017-01407, Exhibit 2012—Declaration of Richard Ferraro in Support of Patent Owner's Reply to Petitioners Opposition to Patent Owners Motion to Amend, filed Jul. 5, 2018, 35 pages.
*Nautilus, Inc.* v. *Icon Health & Fitness, Inc.*, Civil Case No. IPR2017-01407, Exhibit 2013—Cox, Christopher Depo Transcript Jun. 26, 2018, filed Jul. 5, 2018, 26 pages.
*Nautilus, Inc.* v. *Icon Health & Fitness, Inc.*, Civil Case No. IPR2017-01407, Exhibit 2014—Patent Owner Demonstrative Exhibits, filed Aug. 24, 2018, 21 pages.

(56) References Cited

OTHER PUBLICATIONS

*Nautilus, Inc.* v. *Icon Health & Fitness, Inc.*, Civil Case No. IPR2017-01408, Petitioner's Opposition to Patent Owner's Motion to Amend, filed Jun. 4, 2018, 44 pages (paper 21).
*Nautilus, Inc.* v. *Icon Health & Fitness, Inc.*, Civil Case No. IPR2017-01408, Petitioners Motion for Pro Hac Vice Admission, filed Jun. 6, 2018, 5 pages (paper 22).
*Nautilus, Inc.* v. *Icon Health & Fitness, Inc.*, Civil Case No. IPR2017-01408, Patent Owner's Objections to Evidence, filed Jun. 7, 2018, 5 pages (paper 23).
*Nautilus, Inc.* v. *Icon Health & Fitness, Inc.*, Civil Case No. IPR2017-01408, Declaration R. Lee Rawls, Part 1, dated May 12, 2017, 447 pages, (paper 24).
*Nautilus, Inc.* v. *Icon Health & Fitness, Inc.*, Civil Case No. IPR2017-01408, Declaration R. Lee Rawls, Part 2, dated May 12, 2017, 216 pages, (paper 24).
*Nautilus, Inc.* v. *Icon Health & Fitness, Inc.*, Civil Case No. IPR2017-01408, Order granting Motion for Pro Hac Vice Admission, filed Jun. 14, 2018, 4 pages (paper 25).
*Nautilus, Inc.* v. *Icon Health & Fitness, Inc.*, Civil Case No. IPR2017-01408, Petitioner's Updated Mandatory Notices, filed Jun. 20, 2018, 4 pages, (paper 26).
*Nautilus, Inc.* v. *Icon Health & Fitness, Inc.*, Civil Case No. IPR2017-01408, Petitioner's Updated Power of Attorney, filed Jun. 20, 2018, 3 pages, (paper 27).
*Nautilus, Inc.* v. *Icon Health & Fitness, Inc.*, Civil Case No. IPR2017-01408, Patent Owner's Reply to Opposition to Motions to Amend, filed Jul. 5, 2018, 28 pages, (paper 28).
*Nautilus, Inc.* v. *Icon Health & Fitness, Inc.*, Civil Case No. IPR2017-01408, Current Exhibit List of Patent Owner, filed Jul. 5, 2018, 4 pages, (paper 29).
*Nautilus, Inc.* v. *Icon Health & Fitness, Inc.*, Civil Case No. IPR2017-01408, Patent Owner's Updated Mandatory Notices, filed Jul. 5, 2018, 4 pages, (paper 30).
*Nautilus, Inc.* v. *Icon Health & Fitness, Inc.*, Civil Case No. IPR2017-01408, Petitioner's Notice of Deposition of Scott Ganaja, filed Jul. 11, 2018, 3 pages (paper 31).
*Nautilus, Inc.* v. *Icon Health & Fitness, Inc.*, Civil Case No. IPR2017-01408, Joint Notice of Stipulation to Modify Scheduling Order, filed Jul. 12, 2018, 3 pages (paper 32).
*Nautilus, Inc.* v. *Icon Health & Fitness, Inc.*, Civil Case No. IPR2017-01408, Petitioner's Objections to Patent Owner's Evidence, filed Jul. 12, 2018, 4 pages, (paper 33).
*Nautilus, Inc.* v. *Icon Health & Fitness, Inc.*, Civil Case No. IPR2017-01408, Petitioner's Amended Notice of Deposition of Scott Ganaja, filed Jul. 12, 2018, 3 pages, (paper 34).
*Nautilus, Inc.* v. *Icon Health & Fitness, Inc.*, Civil Case No. IPR2017-01408, Order — Conduct of the Proceeding, 37 C.F.R. 42.5, filed Jul. 20, 2018, 5 pages (paper 35).
*Nautilus, Inc.* v. *Icon Health & Fitness, Inc.*, Civil Case No. IPR2017-01408, Petitioner's Sur-Reply in Support of Opposition to Patent Owners Motions to Amend, filed Aug. 1, 2018, 19 pages, (paper 36).
*Nautilus, Inc.* v. *Icon Health & Fitness, Inc.*, Civil Case No. IPR2017-01408, Joint Notice of Stipulation to Modify Scheduling Order, filed Aug. 3, 2018, 3 pages (paper 37).
*Nautilus, Inc.* v. *Icon Health & Fitness, Inc.*, Civil Case No. IPR2017-01408, Order—Conduct of the Proceeding, 37 C.F.R. 42.5, filed Aug. 7, 2018, 4 pages (paper 38).
*Nautilus, Inc.* v. *Icon Health & Fitness, Inc.*, Civil Case No. IPR2017-01408, Patent Owner's Objections to Petitioners Sur Reply, filed Aug. 2, 2018, 5 pages, (paper 39).
*Nautilus, Inc.* v. *Icon Health & Fitness, Inc.*, Civil Case No. IPR2017-01408, Patent Owner's Request for Oral Argument, filed Aug. 10, 2018, 4 pages, (paper 40).
*Nautilus, Inc.* v. *Icon Health & Fitness, Inc.*, Civil Case No. IPR2017-01408, Petitioner's Request for Oral Argument, filed Aug. 10, 2018, 4 pages, (paper 41).
*Nautilus, Inc.* v. *Icon Health & Fitness, Inc.*, Civil Case No. IPR2017-01408, Patent Owner's Motion to Exclude Evidence, filed Aug. 10, 2018, 11 pages (paper 42).
*Nautilus, Inc.* v. *Icon Health & Fitness, Inc.*, Civil Case No. IPR2017-01408, Order—Oral Hearing 37 C.F.R. 42.70, filed Aug. 14, 2018, 5 pages (paper 43).
*Nautilus, Inc.* v. *Icon Health & Fitness, Inc.*, Civil Case No. IPR2017-01408, Petitioner's Opposition to Patent Owner's Motion to Exclude Evidence, filed Aug. 16, 2018, 18 pages (paper 44).
*Nautilus, Inc.* v. *Icon Health & Fitness, Inc.*, Civil Case No. IPR2017-01408, Patent Owners Reply in Support of its Motion to Exclude, filed Aug. 22, 2018, 8 pages, (paper 46).
*Nautilus, Inc.* v. *Icon Health & Fitness, Inc.*, Civil Case No. IPR2017-01408, Current Exhibit List of Patent Owner, filed Aug. 24, 2018, 4 pages (paper 47).
*Nautilus, Inc.* v. *Icon Health & Fitness, Inc.*, Civil Case No. IPR2017-01408, Order Conduct of the Proceedings—37 C.F.R. 42.5, filed Aug. 24, 2018, 4 pages, (paper 48).
*Nautilus, Inc.* v. *Icon Health & Fitness, Inc.*, Civil Case No. IPR2017-01408, Petitioner's Updated Exhibit List, filed Aug. 24, 2018, 5 pages, (paper 49).
*Nautilus, Inc.* v. *Icon Health & Fitness, Inc.*, Civil Case No. IPR2017-01408, Exhibit 1012—U.S. Pat. No. 8.585.561 (Watt), filed Jun. 4, 2018, 32 pages.
*Nautilus, Inc.* v. *Icon Health & Fitness, Inc.*, Civil Case No. IPR2017-01408, Exhibit 1013—U.S. Pat. No. 9,044,635 (Lull), filed Jun. 4, 2018, 21 pages.
*Nautilus, Inc.* v. *Icon Health & Fitness, Inc.*, Civil Case No. IPR2017-01408, Exhibit 1014—U.S. Pat. No. 7,740,563 (Dalebout), filed Jun. 4, 2018, 31 pages.
*Nautilus, Inc.* v. *Icon Health & Fitness, Inc.*, Civil Case No. IPR2017-01408, Exhibit 1015—US20020055418A1 (Pyles), filed Jun. 4, 2018, 9 pages.
*Nautilus, Inc.* v. *Icon Health & Fitness, Inc.*, Civil Case No. IPR2017-01408, Exhibit 1016—US20120258433A1 (Hope), filed Jun. 4, 2018, 51 pages.
*Nautilus, Inc.* v. *Icon Health & Fitness, Inc.*, Civil Case No. IPR2017-01408, Exhibit 1017—U.S. Pat. No. 7,771,320 (Riley), filed Jun. 4, 2018, 44 pages.
*Nautilus, Inc.* v. *Icon Health & Fitness, Inc.*, Civil Case No. IPR2017-01408, Exhibit 1018—Declaration of Christopher Cox in Support of Petitioners Oppositions to Patent Owners Motions to Amend, filed Jun. 4, 2018, 739 pages.
*Nautilus, Inc.* v. *Icon Health & Fitness, Inc.*, Civil Case No. IPR2017-01408, Exhibit 1019—Affidavit of Lane M. Polozola in Support of Petitioners Motion for Pro Hac Vice Admission, filed Jun. 6, 2018, 4 pages.
*Nautilus, Inc.* v. *Icon Health & Fitness, Inc.*, Civil Case No. IPR2017-01408, Exhibit 1020—Scott Ganaja Depo Transcript, filed Aug. 1, 2018, 58 pages.
*Nautilus, Inc.* v. *Icon Health & Fitness, Inc.*, Civil Case No. IPR2017-01408, Exhibit 1021—Petitioner's Demonstrative Exhibits, filed Aug. 24, 2018, 92 pages.
*Nautilus, Inc.* v. *Icon Health & Fitness, Inc.*, Civil Case No. IPR2017-01408, Exhibit 2011—Declaration of Scott Ganaja in Support of Patent Owner's Reply to Petitioner's Opposition to Patent Owner's Motion to Amend, filed Jul. 5, 2018, 42 pages.
*Nautilus, Inc.* v. *Icon Health & Fitness, Inc.*, Civil Case No. IPR2017-01408, Exhibit 2012—Declaration of Richard Ferraro in Support of Patent Owner's Reply to Petitioner's Opposition to Patent Owner's Motion to Amend, filed Jul. 5, 2018, 35 pages.
*Nautilus, Inc.* v. *Icon Health & Fitness, Inc.*, Civil Case No. IPR2017-01408, Exhibit 2013—Cox, Christopher Depo Transcript Jun. 26, 2018, filed Jul. 5, 2018, 26 pages.
*Nautilus, Inc.* v. *Icon Health & Fitness, Inc.*, Civil Case No. IPR2017-01408, Exhibit 2014—Patent Owner's Demonstrative Exhibits, filed Aug. 24, 2018, 21 pages.
European Patent Office, Article 94(3) EPC Communication dated Jul. 10, 2018, issued in European Patent Application No. 14768130.8-1126, 3 pages.
United States Patent and Trademark Office; International Search Report and Written Opinion issued in application No. PCT/US2015/034665; dated Oct. 8, 2015 (14 pages).

(56) References Cited

OTHER PUBLICATIONS

*Nautilus, Inc.* v. *Icon Health & Fitness, Inc.*, Civil Case No's. IPR2017-01363, IPR2017-01407, and IPR2017-01408 Record of Oral Hearing held Aug. 29, 2018; (paper 32) 104 pages.
*Nautilus, Inc.* v. *Icon Health & Fitness, Inc.*, Civil Case No. IPR2017-01407—Petitioner's Updated Exhibit List, filed Aug. 24, 2018, (paper 48) 5 pages.
*Nautilus, Inc.* v. *Icon Health & Fitness, Inc.*, Civil Case No. IPR2017-01363, Final Written Decision dated Nov. 28, 2018; (paper 33) 29 pages.
*Nautilus, Inc.* v. *Icon Health & Fitness, Inc.*, Civil Case No's. IPR2017-01407, Final Written Decision dated Dec. 3, 2018; (paper 50) 81 pages.
*Nautilus, Inc.* v. *Icon Health & Fitness, Inc.*, Civil Case No's. IPR2017-01408, Final Written Decision dated Dec. 3, 2018; (paper 51) 82 pages.
U.S. Appl. No. 16/572,272; filed Sep. 16, 2019, titled "Cable Exercise Machine", (35 pages).
U.S. Appl. No. 62/310,467, filed Mar. 18, 2016, titled "Collapsible Strength Exercise Machine", 31 pages.
U.S. Appl. No. 62/429,977, filed Dec. 5, 2016, titled "Pull Cable Resistance Mechanism in a Treadmill", 37 pages.
U.S. Appl. No. 62/429,970, filed Dec. 5, 2016, titled "Tread Belt Locking Mechanism", 37 pages.
International Bureau of WIPO; International Preliminary Report on Patentability; Int'l App No. PCT/US2017/064523 dated Jun. 11, 2019; 7 pages.
International Bureau of WIPO; International Preliminary Report on Patentability; Int'l App No. PCT/US2017/064536 dated Jun. 11, 2019; 8 pages.
Chinese Second Office Action for Chinese Patent Application No. 201480003701.9 dated Nov. 21, 2016.
Chinese Third Office Action for Chinese Patent Application No. 201480003701.9 dated Nov. 24, 2017.
Chinese Office Action for Chinese Patent Application No. 201580033332 dated Feb. 28, 2018.
Chinese Second Office Action for Chinese Patent Application No. 201580033332 dated Nov. 15, 2018.
Nordic Track Fusion CST Series; website; located at: http://www/nordictrack.com/fusion-cst-series; accessed on Jan. 24, 2018; 11 pages.
U.S. Appl. No. 15/460,984, dated Jun. 24, 2019, Notice of Allowance.
U.S. Appl. No. 62/804,146, filed Feb. 11, 2019, titled Cable and Power Rack Exercise Machine, 49 pages.
U.S. Appl. No. 16/780,765, filed Feb. 3, 2020, titled Cable and Power Rack Exercise Machine, 48 pages.
U.S. Appl. No. 16/787,850, filed Feb. 11, 2020, titled Exercise Machine, 40 pages.
International Patent Application No. PCT/US20/17710, filed Feb. 11, 2020, titled Exercise Machine, 41 pages.
First Office Action and Search Report with English translation issued in Taiwan application 106135830 dated Jun. 15, 2018.
U.S. Appl. No. 16/742,762, filed Jan. 14, 2020, titled Controlling an Exercise Machine Using a Video Workout Program, 146 pages.
U.S. Appl. No. 16/750,925, filed Jan. 2, 2020, titled Systems and Methods for an Interactive Pedaled Exercise Device, 54 pages.
U.S. Appl. No. 62/914,007, filed Oct. 11, 2019, titled Modular Exercise Device, 128 pages.
U.S. Appl. No. 62/934,291, filed Nov. 12, 2019, titled Exercise Storage System, 41 pages.
U.S. Appl. No. 62/934,297, filed Nov. 12, 2019, titled Exercise Storage System, 44 pages.

* cited by examiner

900

1000

TREAD BELT LOCKING MECHANISM

RELATED APPLICATIONS

This application claims priority to U.S. patent application Ser. No. 62/429,970 titled "Tread Belt Locking Mechanism" and filed on Dec. 5, 2016, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling, among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user will use an aerobic exercise machine to perform an aerobic workout indoors. One type of aerobic exercise machine is a treadmill, which is a machine that has a running deck attached to a support frame. The running deck can support the weight of a person using the machine. The running deck incorporates a conveyor belt that is driven by a motor. A user can run or walk in place on the conveyor belt by running or walking at the conveyor belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical trainers, rowing machines, stepper machines, and stationary bikes to name a few.

One type of treadmill is disclosed in U.S. Pat. No. 4,151,988 issued to Herman G. Nabinger. In this reference, an apparatus for retarding the momentum of a treadmill includes a flywheel operatively associated with the belt of the treadmill, a brake arranged to move into and out of engagement with the flywheel and a manually operated lever for operating the brake whereby a person on the treadmill can, at his or her option, retard or stop the motion of the treadmill. Other exercise machines are disclosed in U.S. Pat. No. 8,876,668 issued to Rick W. Hendrickson; European Patent Application No. EP1188460 issued to Gary E. Oglesby; WIPO Publication No. WO/1989/002217 issued to William Lindsey; and U.S. Patent Publication No. 2002/0103057 issued to Scott Watterson.

SUMMARY

In one embodiment, a treadmill may include a deck, a first pulley disposed in a first portion of the deck, a second pulley disposed in a second portion of the deck, a tread belt surrounding the first pulley and the second pulley, and a locking mechanism that selectively prevents the tread belt from moving.

The treadmill may also include an upright structure connected to the deck. The treadmill may also include a pull cable incorporated into the upright structure.

A handle may be connected to a first end of the pull cable and a resistance mechanism connected to a second end of the pull cable.

The treadmill may include flywheel of the resistance mechanism where the flywheel is incorporated into the upright structure and a magnetic unit that applies a resistance to a rotation of the flywheel.

The treadmill may include a sensor that detects movement of the flywheel.

The sensor may be in electronic communication with the locking mechanism.

The treadmill may also include an input mechanism incorporated into the upright structure where the input mechanism controls the locking mechanism.

The locking mechanism may lock the tread belt from moving when the pull cable is being pulled.

The locking mechanism may lock the tread belt in response to a pull force on the pull cable.

The treadmill may also include a processor and memory that includes programmed instructions to cause the locking mechanism to lock movement of the tread belt.

The treadmill may also include a surface of the tread belt, an opening defined in the surface, a retractable pin connected to the deck, and an inserting mechanism that inserts the retractable pin into the opening when locking mechanism is active.

The treadmill may also include a magnetic mechanism positioned adjacent at least one of the first pulley and the second pulley.

The locking mechanism may be electronically operated.

The locking mechanism may be manually operated.

The treadmill may also include a motor in mechanical communication with at least one of the first pulley and the second pulley. The motor may, when active, causes the tread belt to move. The locking mechanism may prevent the tread belt from moving when the motor is inactive.

In one embodiment, a method includes locking a position of the tread belt of a treadmill.

The upright structure may include a weighted object accessible to the user from the deck and movable in the performance of an exercise.

The treadmill may include a handrail connected to the upright portion accessible to the user from the deck during the performance of an exercise.

The handrail may include a pivot attachment to the upright structure.

The handrail may be pivotable upward with respect to the upright structure when the deck is raised.

The handrail may be pivotable downward with respect to the upright structure when the deck is raised.

The handrail may include a first holding region protruding away from the upright structure and a second holding region protruding away from the upright structure. The first holding region may be aligned with the second holding region, and the first holding region may be disposed over a first side of the deck and the second holding region may be disposed over a second side of the deck.

In one embodiment, an apparatus may include a deck, a first pulley disposed in a first portion of the deck, a second pulley disposed in a second portion of the deck, a tread belt surrounding the first pulley and the second pulley, and a locking mechanism that selectively prevents the tread belt from moving, a processor, memory in electronic communication with the processor, and instructions stored in the memory. The instructions may be operable to cause the processor to lock a position of the tread belt of a treadmill.

Locking a position of the tread belt may include locking the tread belt in response to movement of a pull cable.

Some examples of the method and apparatus described above may further include processes, features, means, or instructions for sensing movement of a pull cable incorporated into the treadmill.

Some examples of the method and apparatus described above may further include processes, features, means, or instructions for sensing rotation of a flywheel of a resistance mechanism.

In some examples, locking a position of the tread belt includes locking the tread belt in response to a rotation of a flywheel of a resistance mechanism.

In one embodiment, a treadmill includes a deck, a first pulley disposed in a first portion of the deck, a second pulley disposed in a second portion of the deck, a tread belt surrounding the first pulley and the second pulley, a motor in mechanical communication with at least one of the first pulley and the second pulley that when active causes the tread belt to move, a locking mechanism that prevents the tread belt from moving when the motor is inactive, an upright structure connected to the deck, a pull cable incorporated into the upright structure, a handle connected to a first end of the pull cable, a resistance mechanism connected to a second end of the pull cable, a flywheel of the resistance mechanism, the flywheel being incorporated into the upright structure, a magnetic unit that applies a resistance to a rotation of the flywheel, a sensor that detects movement of the flywheel, the sensor is in electronic communication with the locking mechanism, and wherein the locking mechanism prevents movement of the tread belt in response to movement of the flywheel.

In one embodiment, a treadmill includes a deck, a first pulley disposed in a first portion of the deck, a second pulley disposed in a second portion of the deck, a tread belt surrounding the first pulley and the second pulley, a motor in mechanical communication with at least one of the first pulley and the second pulley that, when active, causes the tread belt to move, a locking mechanism that prevents the tread belt from moving when the motor is inactive, an upright structure connected to the deck, a processor, a memory in electronic communication with the processor, and instructions stored in the memory and operable, when executed by the processor. The instructions include commands for selectively locking a position of the tread belt based on an input from an mechanism incorporated into the upright structure that is in communication with the processor. The input mechanism sends commands to the locking mechanism in response to activation by the user.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. Often, the width of an object is transverse the object's length.

Figure 1:
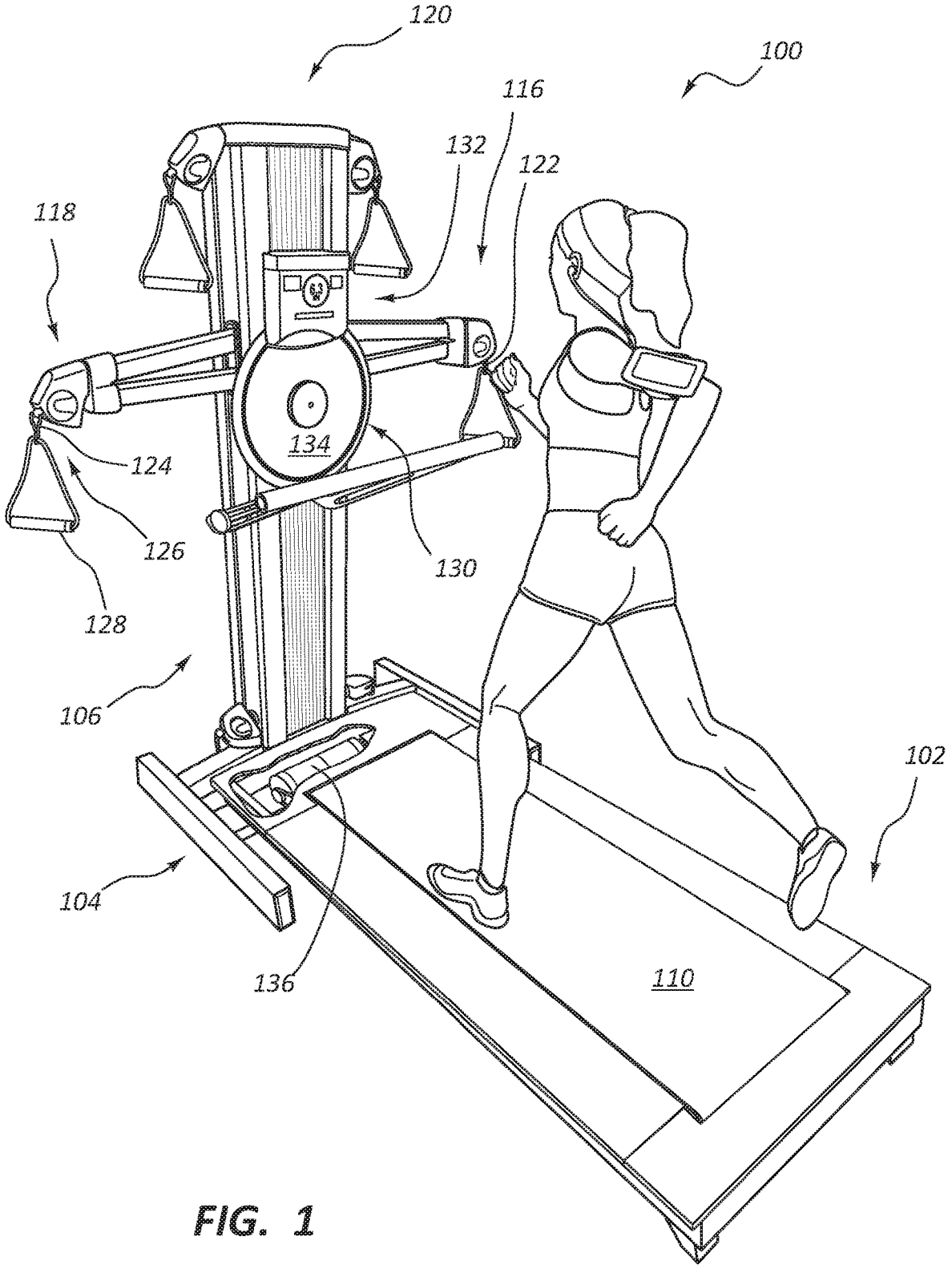
FIG. 1 depicts an example of a treadmill.

FIG. 1 depicts an example of a treadmill 100 that includes a deck 102, a base 104, and an upright structure 106. The deck 102 includes a front pulley connected to a front portion of the deck 102, and a rear pulley connected to a rear portion of the deck 102. A tread belt 110 surrounds a portion of the deck 102, the front pulley, and the second pulley. A motor 136 can drive either the front pulley or the rear pulley and cause the tread belt 110 to move along a surface of the deck 102.

An upright structure 106 is connected to the base 104. In this example, the upright structure includes a first arm 116 and a second arm 118 extending away from a central portion 120 of the upright structure 106. The first arm 116 supports a first cable 122, and the second arm 118 supports a second cable 124. The first and second cables each have an end 126 that is attached to a handle 128. The other end of the first and second cables are attached to a resistance mechanism 130 that is connected to the upright structure 106. A display 132 is also attached to the upright structure 106 which displays information about the user's workout involving the movement of the tread belt. In this example, the resistance mechanism includes a flywheel 134, and the rotation of the flywheel is resisted with a magnetic unit.

In this example, a user is exercising on the deck 102 with the tread belt 110 moving. The movement of the tread belt may be driven by a motor 136. In other examples, the movement of the tread belt 110 may be driven by the user's feet.

Figure 2:
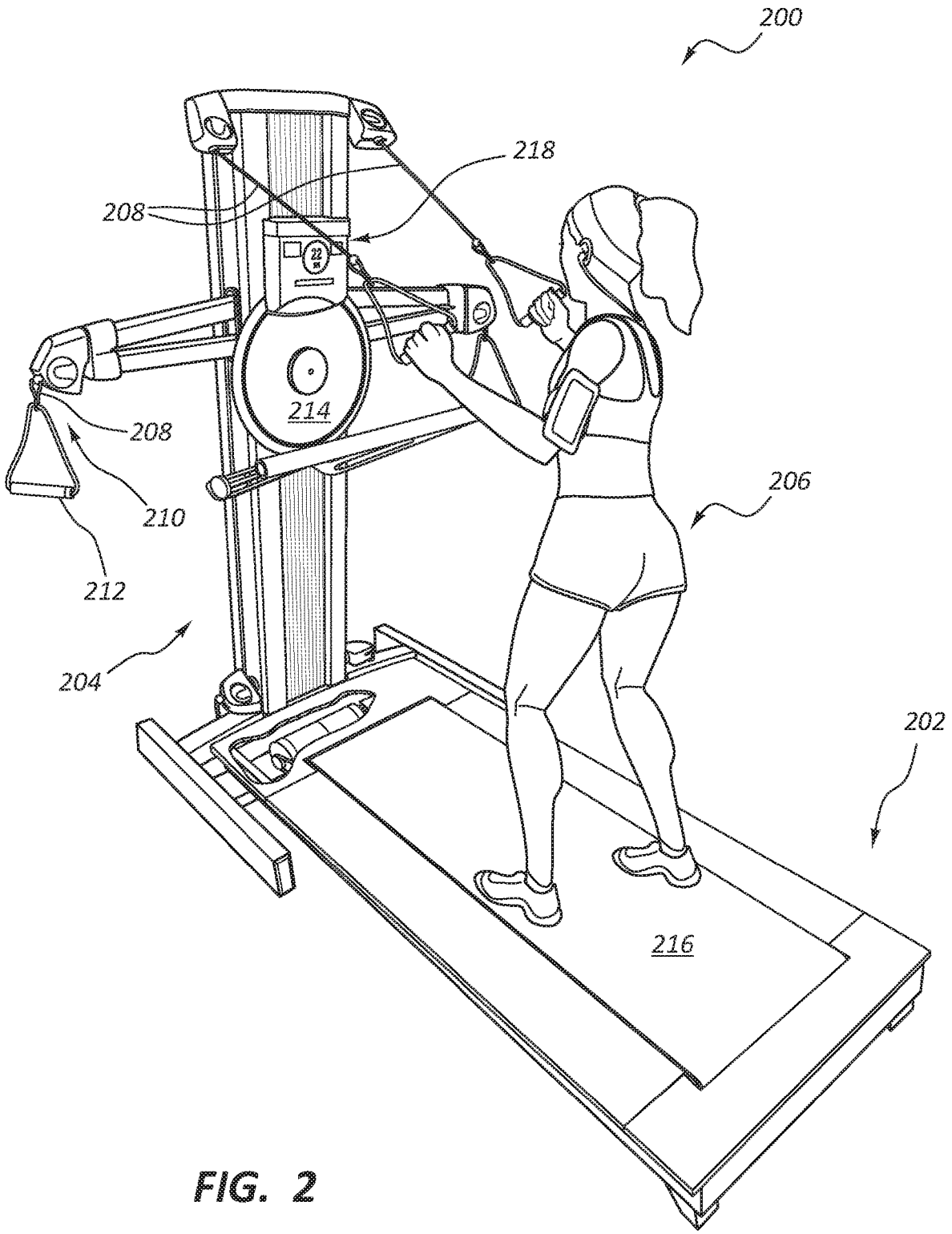
FIG. 2 depicts an example of an alternative treadmill.

FIG. 2 depicts an example of a treadmill 200 with the deck 202 and the upright structure 204. In this example, the user 206 is exercising with the pull cables 208 incorporated into the upright structure 204. As the user pulls the end 210 of the pull cable 208 with the handle 212, the pull cable 208 moves along its length. The end of the pull cable 208 connected to the resistance mechanism causes the flywheel 214 to rotate against resistance.

Further, in the illustrated example, the user 206 stands on the tread belt 216 while performing an exercise with the pull cables 208. While the user 206 is executing the pull cable exercises, the tread belt 216 is locked in place so that the tread belt 216 cannot move. As a result, the user 206 can stand on the tread belt and pull against resistance without having the tread belt 216 move from the pull cable exercises. In this example, the display 218 presents information about the user's workout involving the movement of the pull cables 208.

Figure 3:
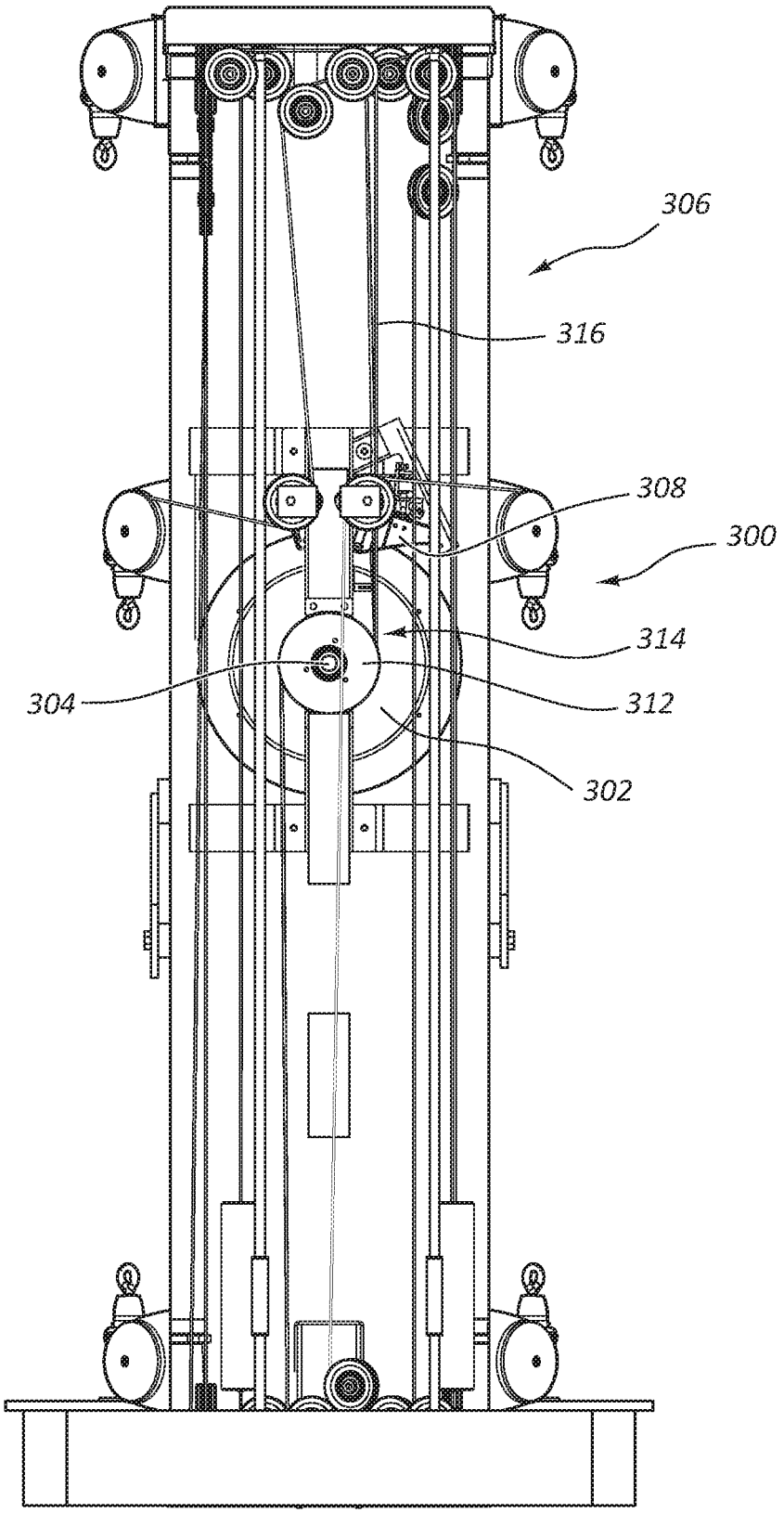
FIG. 3 depicts an example of a resistance mechanism.

FIG. 3 depicts an example of a resistance mechanism 300. In this example, the resistance mechanism 300 includes a flywheel 302 that is supported by an axle 304 connected to the upright structure 306. A magnetic unit 308 is positioned adjacent to the flywheel 302. In some examples, the magnetic unit 308 is positioned adjacent to a periphery 310 of the flywheel 302. The magnetic unit 308 may impose a magnetic force on the flywheel 302 that resists the flywheel's rotation. In some cases, the strength of the magnetic unit's resistance may be increased by moving the magnetic unit 308 closer to the flywheel 302. Conversely, in the same example, the strength of the resistance may be lowered by moving the magnetic unit farther away from the flywheel 302. In an alternative example, the strength of the magnetic unit 308 may be altered by changing an electrical power level to the magnetic unit 308. Also disposed on the axle 304 is a spool 312 where the second end 314 of the pull cable 316 connects to the resistance mechanism 300. As the pull cable 316 is pulled from the first end, the second end 314 of the cable moves causing the spool 312 to rotate.

Figure 4:
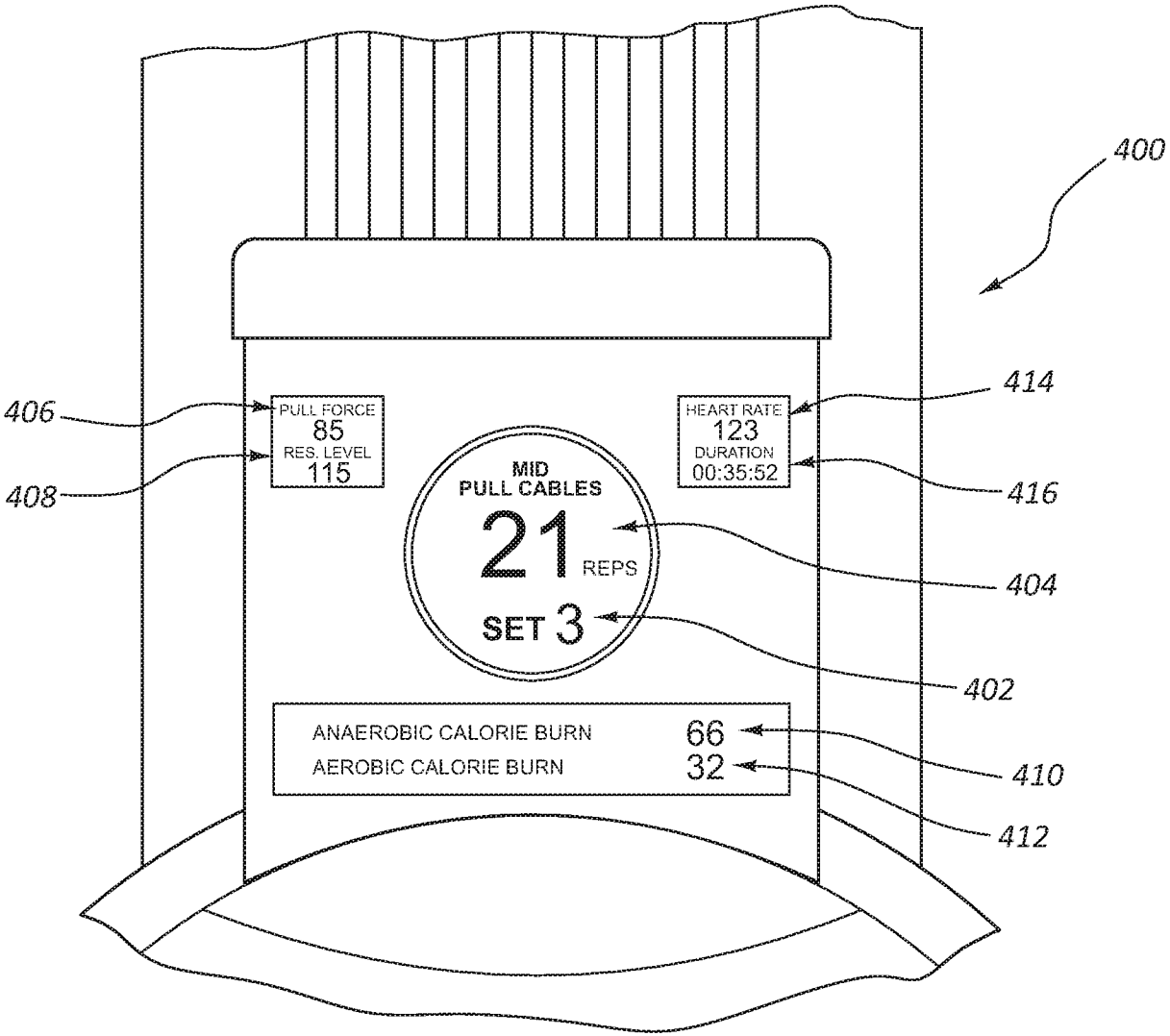
FIG. 4 depicts an example of a display.

FIG. 4 depicts an example of a display 400. In this example, the display 400 may have fields for presenting a number of pull cable sets 402, a number of pull cable repetitions 404, an average pull force 406 on the cable, a resistance level 408, an anaerobic calorie burn 410, an aerobic calorie burn 412, a heart current rate 414, and a running time duration 416.

Figure 5:
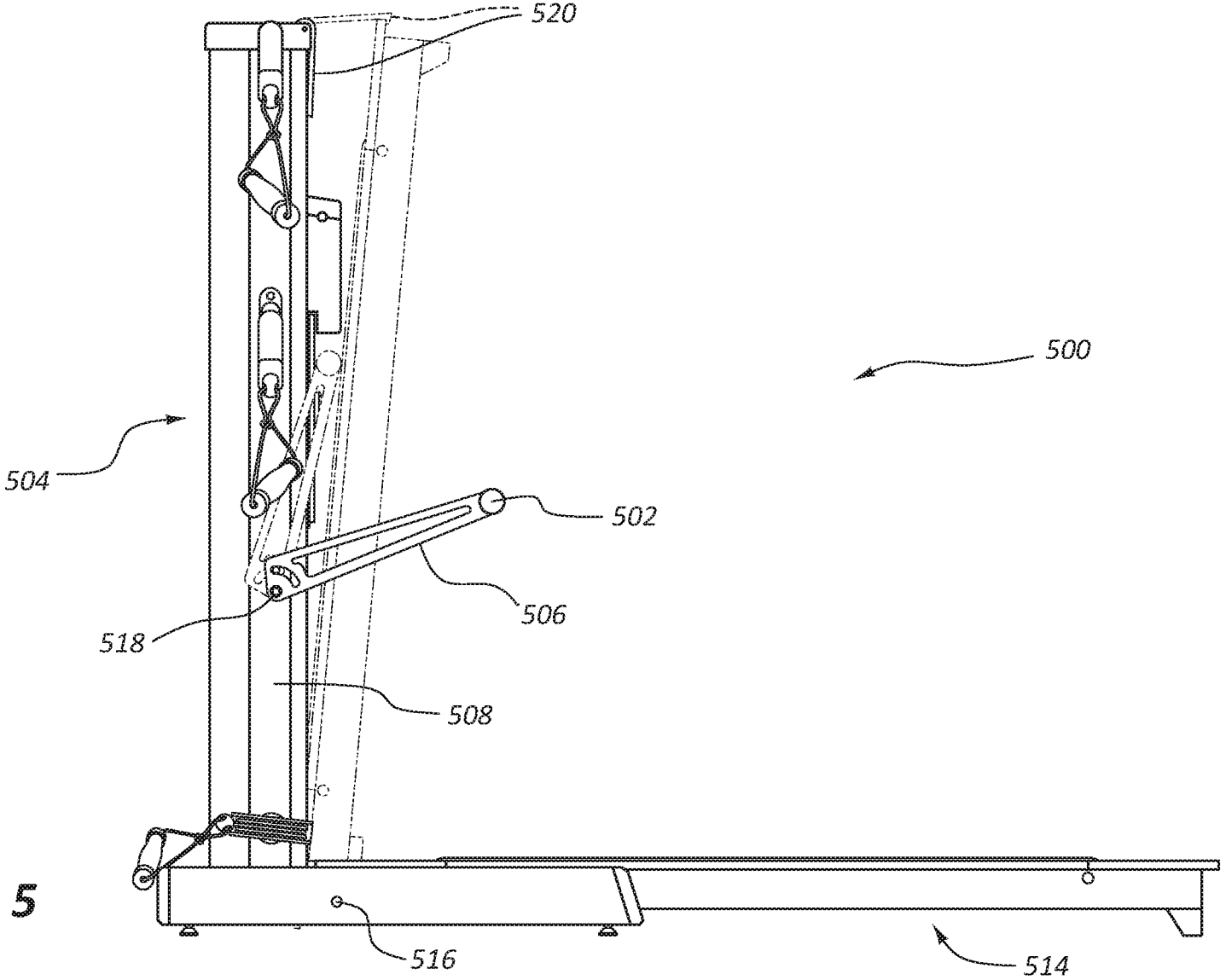
FIG. 5 depicts an example of an alternative treadmill.

FIG. 5 depicts an example of a treadmill 500. In this example, a handrail 502 is connected to the upright structure 504. The handrail 502 includes a first post 506 connected to a first side 508, and a second post connected to a second side. Each of the first and second posts are pivotally connected to the upright structure.

The deck 514 may be connected to the upright structure 504 at a base pivot connection 516. As the deck 514 is rotated upwards, the deck 514 engages the handrail 502 before arriving at the deck's storage position. As the deck 514 continues to move upward after engaging the handrail 502, the posts of the handrail 502 rotate about the post pivot connections 518. Thus, as the deck 514 continues to move upward, the deck 514 and the handrail 502 move upward together. When the deck 514 arrives at the storage position, a latch 520 may be used to hold the deck 514 in the storage position. Thus, the deck 514 and the handrail 502 are held in an upward, storage position with a single latch 520.

Figure 6:
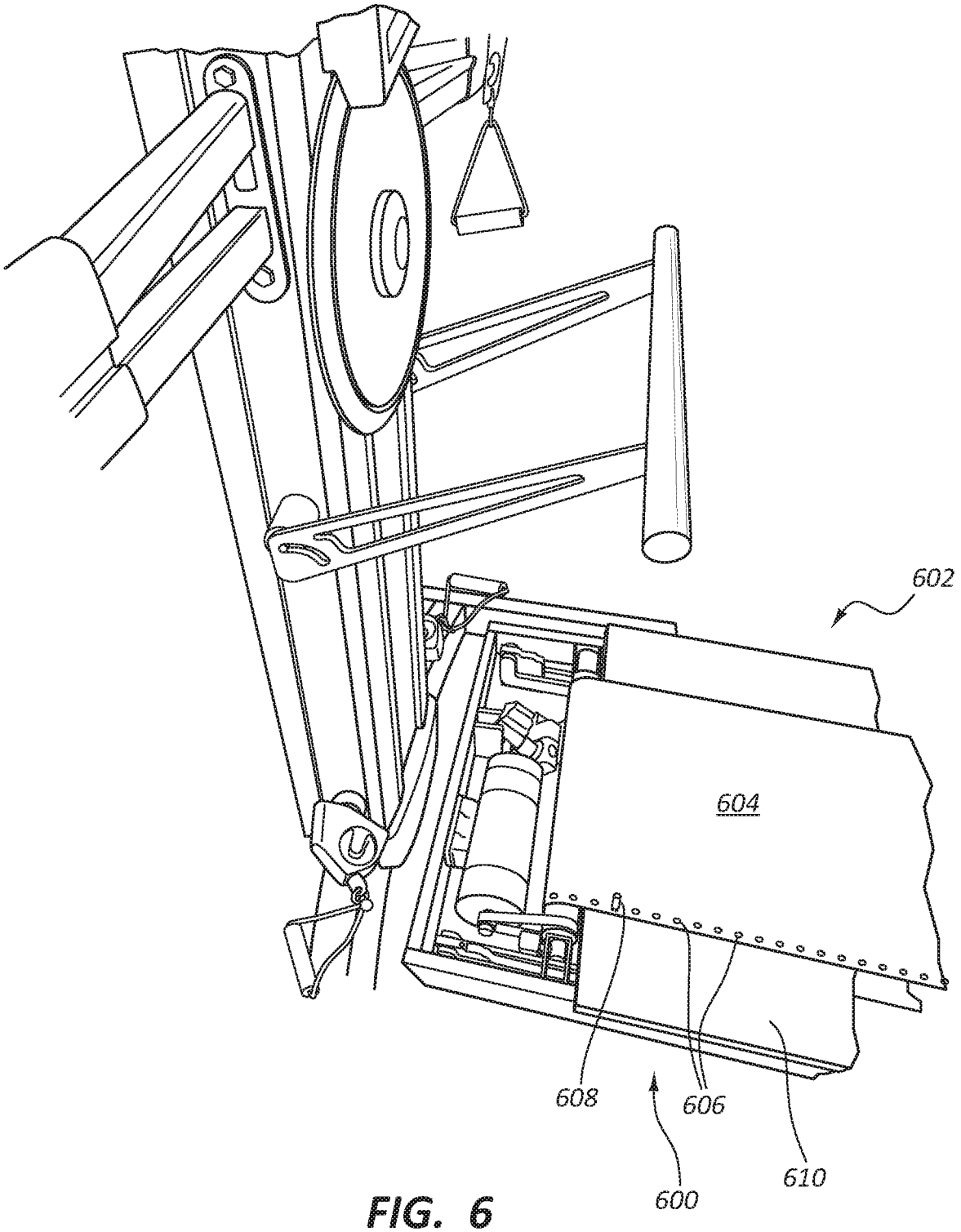
FIG. 6 depicts an example of a locking mechanism.

FIG. 6 depicts an example of a locking mechanism 600. In this example, a tread belt 602 includes a surface 604 with an opening 606 defined in the surface 604. A retractable pin 608 connected to the deck 610 can be positioned adjacent to the opening 606 and be insertable into the opening 606. With the pin 608 inserted into the opening 606, the tread belt 602 is locked in place so that the tread belt 602 does not move.

Figure 7:
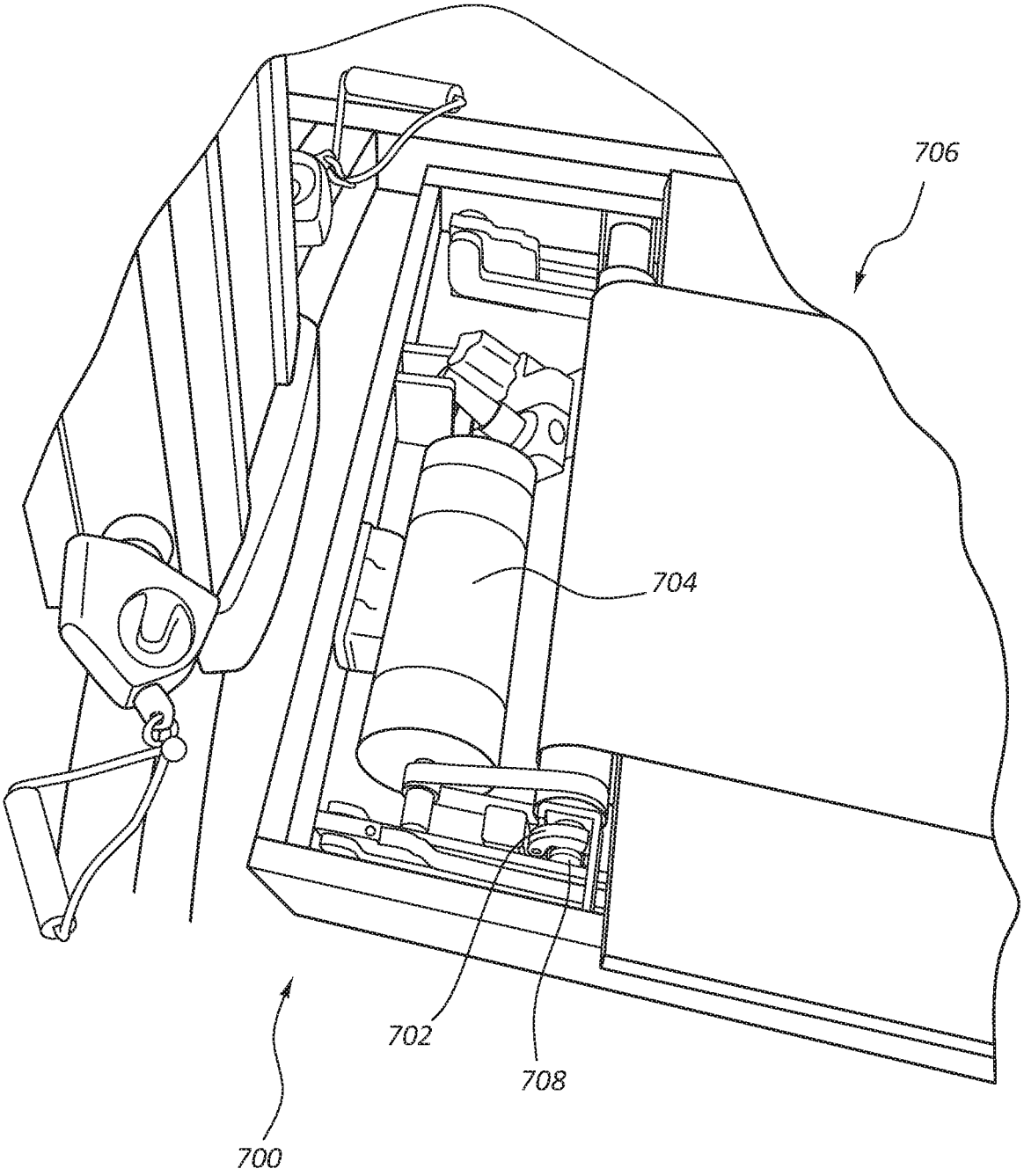
FIG. 7 depicts an example of an alternative locking mechanism.

FIG. 7 depicts an example of an alternative locking mechanism 700. In this example, the locking mechanism includes a clamp 702 that is positioned adjacent to a pulley 704 that drives the tread belt 706. The clamp 702 can apply a force on the pulley 704 or on an axle 708 supporting the pulley 704 so that the pulley 704 and/or the axle 708 cannot rotate. This can lock the tread belt 706 in place.

Figure 8:
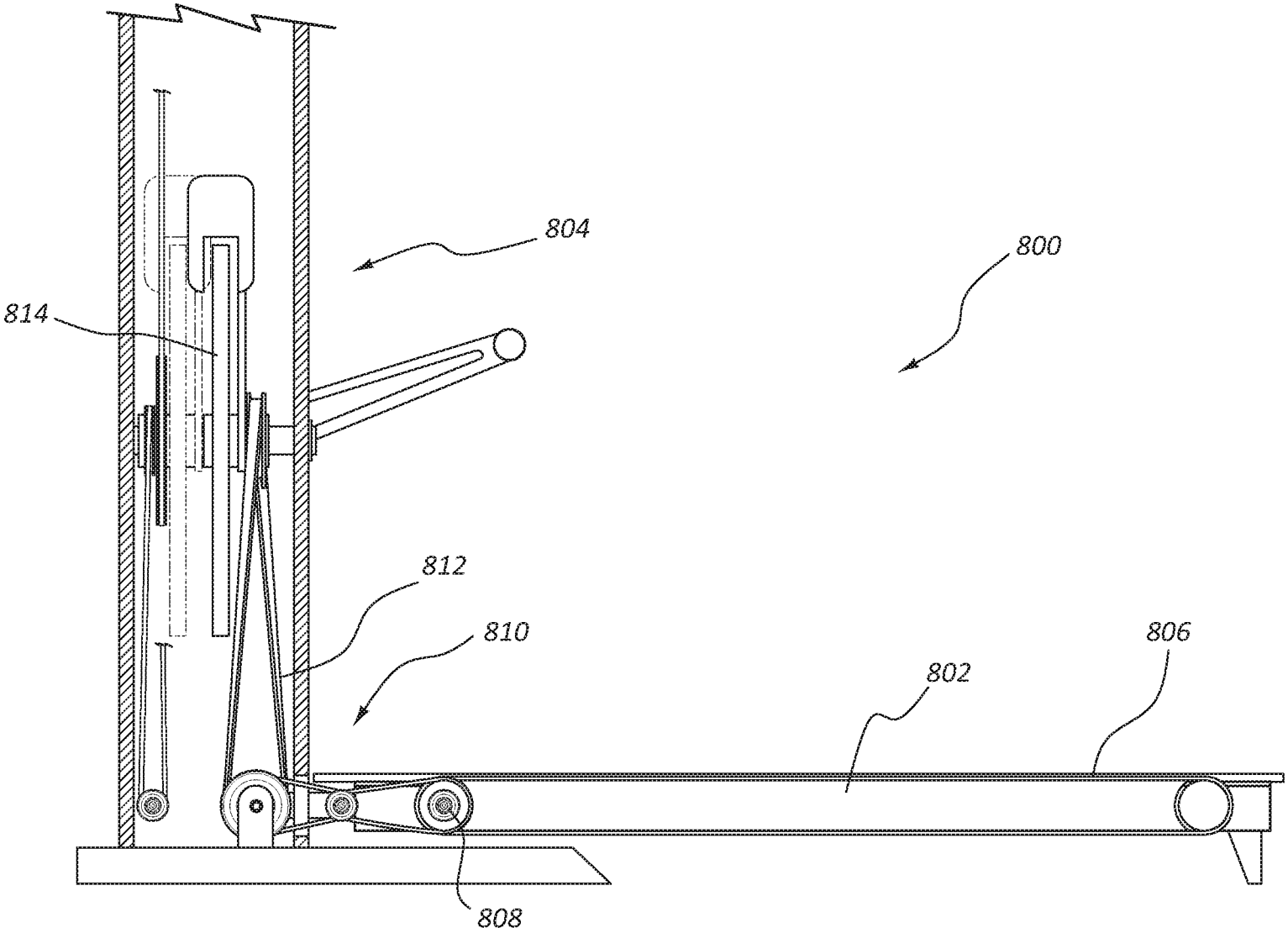
FIG. 8 depicts an example of an alternative treadmill.

FIG. 8 depicts an example of a treadmill 800. In this example, the treadmill 800 includes a deck 802 and an upright structure 804. The deck 802 includes a tread belt 806 that is driven by the user's power. In this example, as the user causes the tread belt 806 to move with his or her legs, the front pulley 808 rotates. A transmission system 810 includes a transmission linkage 812 that connects the front pulley 808 to the flywheel 814 in the upright structure 804. As the tread belt 806 continues to move, the inertia of the tread belt's movement is stored in the flywheel 814. When the tread belt 806 is locked in place with the locking mechanism, the flywheel can be used to provide resistance to the user's pull cable exercises. Thus, a single flywheel 814 may be used for the aerobic exercises and the pull cable exercises.

Figure 9:
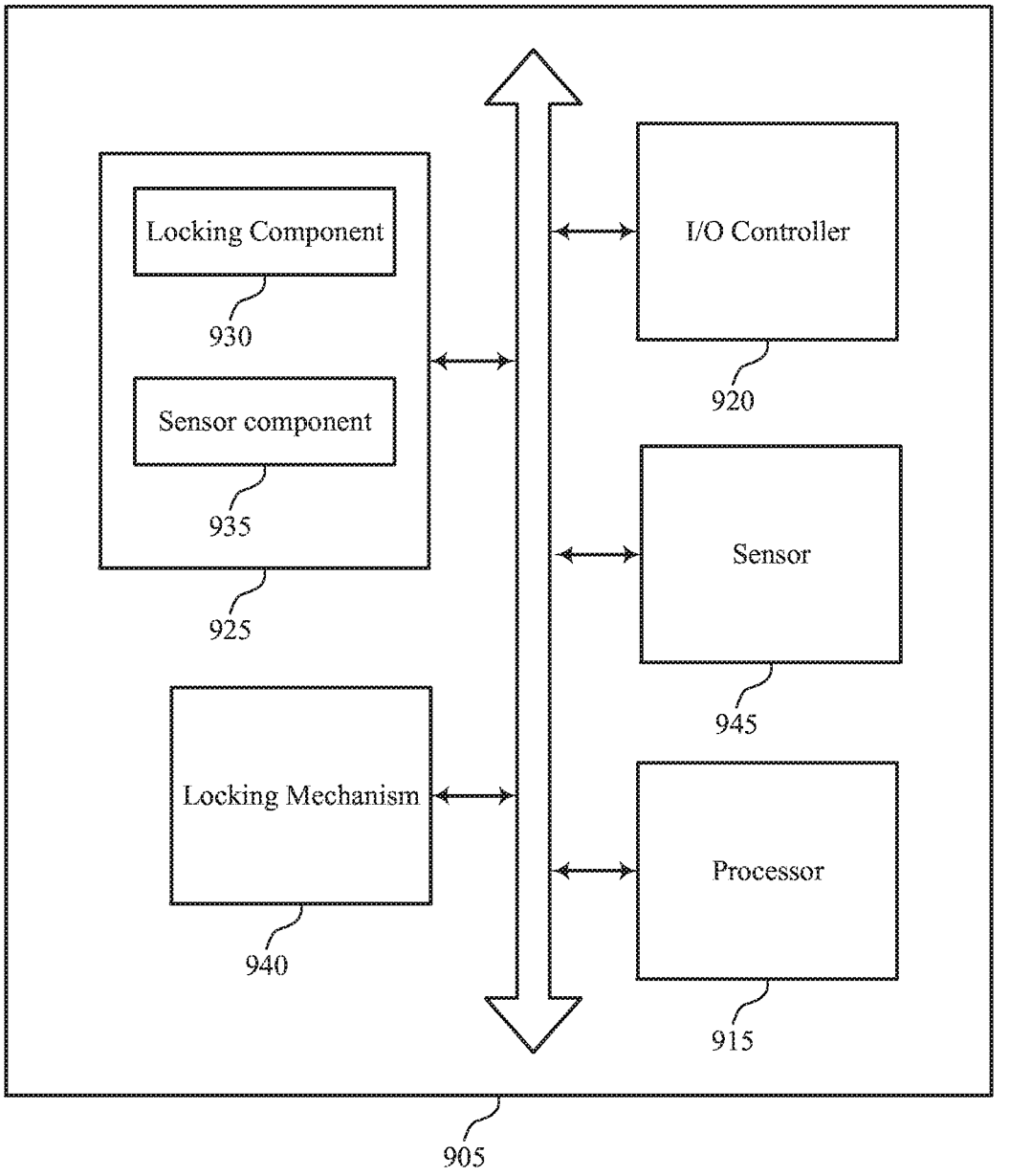
FIG. 9 depicts an example of a block diagram of a system.

FIG. 9 depicts a diagram of a system 900 including a treadmill 905 that supports a tread belt locking mechanism in accordance with various aspects of the present disclosure. The treadmill 905 may include components for bi-directional voice and data communications including components for transmitting and receiving communications, including processor 915, I/O controller 920, and memory 925. Memory 925 may also include locking component 930 and sensor component 935. The memory 925 may be in communication with the locking mechanism 940 and a sensor 945.

Figure 10:
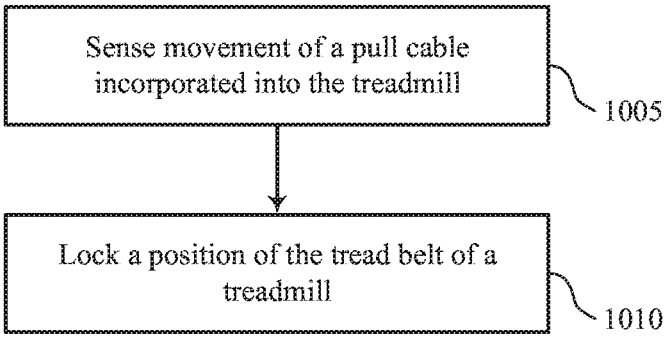
FIG. 10 depicts an example of a method for locking a tread belt.

FIG. 10 depicts a flowchart illustrating a method 1000 for locking a tread belt in accordance with various aspects of the present disclosure. The operations of method 1000 may be implemented by a treadmill or its components as described herein. In some examples, a treadmill may execute a set of codes to control the functional elements of the treadmill to perform the functions described below. Additionally or alternatively, the treadmill may perform aspects the functions described below using special-purpose hardware. At block 1005, the treadmill may sense movement of a pull cable incorporated into the treadmill. At block 1010, the treadmill may lock a position of the tread belt.

Figure 11:
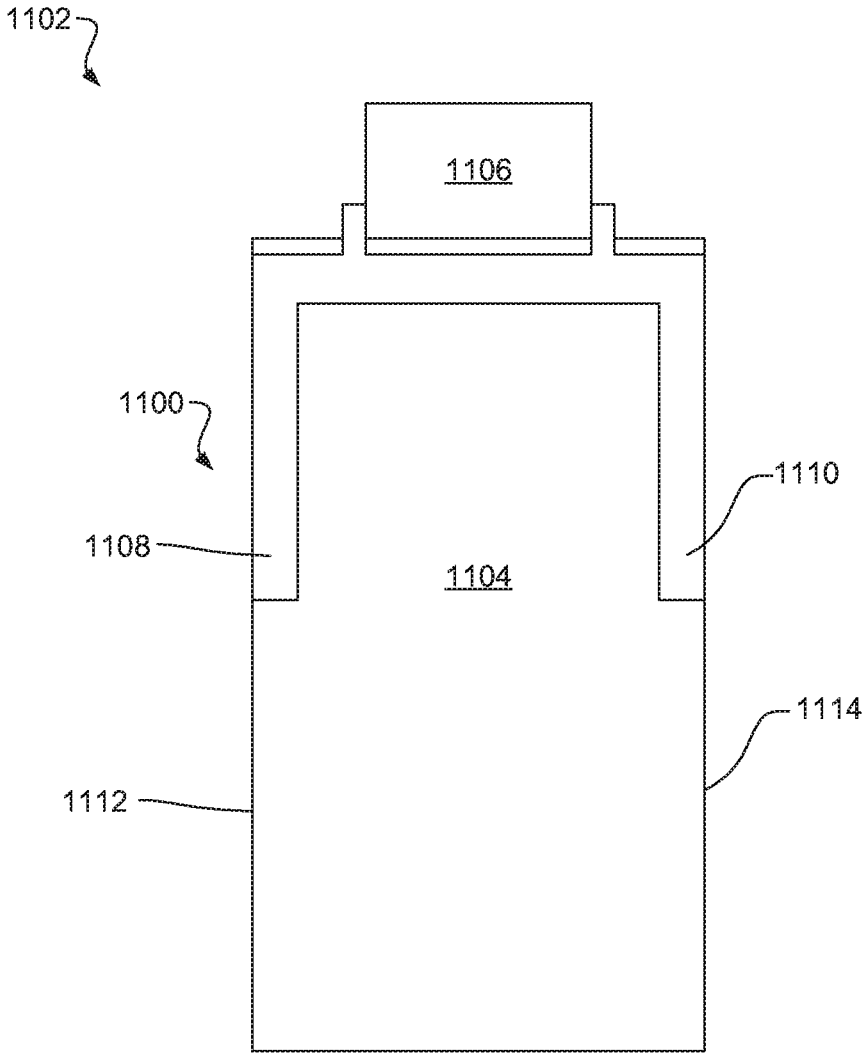
FIG. 11 depicts an example of a handrail.

FIG. 11 depicts an example of a handrail 1100. In this example, the treadmill 1102 includes a deck 1104 and an upright structure 1106. The handrail 1100 is connected to the upright structure 1106.

The handrail 1100 includes a first holding region 1108 protruding away from the upright structure 1106 and a second holding region 1110 protruding away from the upright structure 1106. The first holding region 1108 and the second holding region 1110 are aligned with one another. The first holding region 1108 is superjacent the first side 1112 of the deck 1104, and the second holding region 1108 is superjacent the second side 1114 of the deck 1104.

Figure 12:
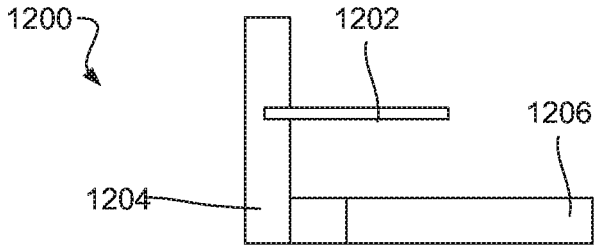
FIG. 12 depicts an example of an alternative handrail.

FIG. 12 depicts an example of a treadmill 1200 with a handrail 1202 protruding from the upright structure 1204. In this example, the deck 1206 is in an operational orientation so that a user can perform an exercise on the deck 1206. the handrail 1202 is protruding away from the upright structure 1204 so that the handrail 1202 is aligned with or relatively parallel with the deck 1206.

Figure 13:
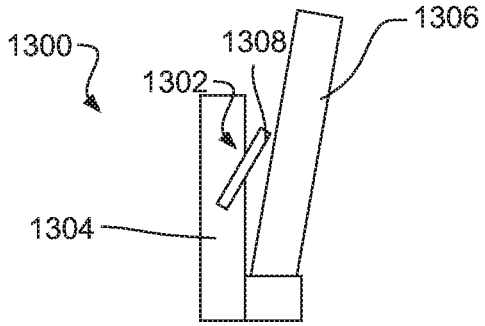
FIG. 13 depicts an example of another alternative handrail.

FIG. 13 depicts an example of a treadmill 1300 with a handrail 1302 protruding from the upright structure 1304. In this example, the deck 1306 is in a storage orientation wherein the deck 1306 has be rotated upwards towards the upright structure 1304. In this example, the handrail 1302 is protruding away from the upright structure 1304 at an inclined angle where a distal end 1308 of the handrail 1302 was raised to a higher elevation than when the handrail 1302 was in an operational position.

Figure 14:
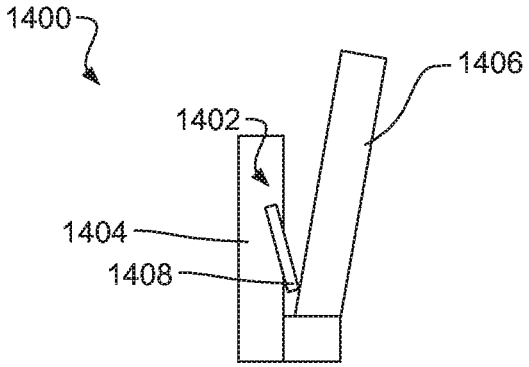
FIG. 14 depicts an example of a fourth alternative handrail.

FIG. 14 depicts an example of a treadmill 1400 with a handrail 1402 protruding from the upright structure 1404. In this example, the deck 1406 is in a storage orientation wherein the deck 1406 has be rotated upwards towards the upright structure 1404. In this example, the handrail 1402 is protruding away from the upright structure 1404 at an inclined angle where a distal end 1408 of the handrail 1402 was raised to a lower elevation than when the handrail 1402 was in an operational position.

General Description

In general, the invention disclosed herein may provide users with a treadmill that includes a locking mechanism that prevents movement of the treadmill's tread belt. For purposes of this disclosure, a locking mechanism differs from commercially available systems that slow movement of a tread belt with a disengagement system or with a braking system. Disengagement systems may merely decouple the mechanism driving the tread belt from the tread belt thereby allowing the tread belt's movement to slow to a stop in the absence of a driving force. Braking systems are also intended to slow the movement of the tread belt by applying an active force on the tread belt, but braking systems have to apply the force without damaging a moving tread belt. In some examples, a locking mechanism may or may not have to account for movement of the tread belt as the locking mechanism applies an active force on the tread belt before the tread belt moves.

One reason why the locking mechanism differs from braking or disengagement systems is that the locking mechanism serves a different function. The braking and disengagement systems are used to control the speed of the tread belt when the treadmill is used to perform an aerobic exercise on the treadmill based on the movement of the tread belt. The locking mechanism, on the other hand, is used to secure the tread belt against rotation when the tread belt is used to perform an anaerobic exercise on the tread belt based on the movement of a component of the treadmill that is different than the tread belt. In these cases, the locking mechanism may initially engage the tread belt or associated component when the tread belt is at rest. On the other hand, the braking system has to engage the tread belt when the tread belt is already moving. Since the locking mechanism does not have to accommodate the tread belt's movement, the locking mechanism can use a greater variety of mechanisms to lock the belt in place. For example, a retractable pin inserted into a stationary tread belt is a locking mechanism that is available for preventing movement of the tread belt, but a retractable pin would damage a moving tread belt.

In those examples where the treadmill includes a pull cable system, the user may cause the tread belt to be locked into place while the user exerts a force on the pull cable. The dynamics involved with pulling on the pull cable against resistance imposes a force on the tread belt to move when the pull force is applied. In the absence of the locking mechanism, the tread belt may move when the user executes a pull cable exercise. However, with the locking mechanism, the tread belt is restrained from movement allowing the user to perform the pull cable exercise.

While the above example describes the locking mechanism in relation to a treadmill with a pull cable system, other anaerobic exercise components may be incorporated into the treadmill and used in conjunction with the locking mechanism. For example, the treadmill may include a locking mechanism when the treadmill is equipped to assist the user in performing an exercise on the deck involving free weight lifts, squat lifts, jumping exercises, core exercises, pressing exercise, pulling exercises, other types of exercises, or combinations thereof.

In one example, the treadmill may include a deck, a first pulley, a second pulley, a tread belt, a locking mechanism, an upright structure, a pull cable, a handle, a resistance mechanism, a flywheel, a magnetic unit, a sensor, an input mechanism, a processor, a memory, a tread belt surface, an opening defined in the tread belt surface, a retractable pin, an inserting mechanism for inserting the pin in the opening, a motor, and a resistance mechanism.

The deck may include a first pulley disposed in a first portion of the deck, and a second pulley disposed in a second portion of the deck. The tread belt may surround the first pulley and the second pulley. In some cases, a motor is in mechanical communication with at least one of the first pulley and the second pulley. When the motor is active, the motor may cause the tread belt to move. In these types of examples, the user can control the speed of the tread belt through an input mechanism.

In other examples, the tread belt is driven by the user's power. In these types of examples, the vector force from the user's leg pushing against the length of the tread deck's surface causes the tread belt to move. A flywheel may be used to store inertia from the user driven movement of the tread belt. In these situations, the speed of the tread belt is controlled based on the effort inputted by the user's workout.

The locking mechanism may selectively prevent the tread belt from moving. In some cases, the locking mechanism is incorporated into a treadmill with a motor that drives movement of the treadmill. In other examples, the locking mechanism is incorporated into treadmills where the movement of the tread belt is moved by the user's walking/running power. In some examples, the locking mechanism may include a component that interlocks with the tread belt or another portion of the drive train that moves with the tread belt.

Any appropriate type of locking mechanism may be used in accordance with the principles described herein. In some cases, the locking mechanism is electronically operated. In other cases, the locking mechanism is manually operated. In one example, the locking mechanism applies a force directly to the tread belt to prevent movement. In other examples, the locking mechanism applies a force to at least one of the deck's pulleys and/or an axles supporting the deck pulleys. In yet another example, the locking mechanism applies a force to a flywheel in mechanical communication with tread belt.

In one example, the tread belt includes a surface, and a force is applied to the surface with the locking mechanism to prevent movement. The surface may include an area in a plane, and the force may be applied in a direction transverse the plane. This may be accomplished by applying a compressive force to the surface and applying an opposing force to an opposing side of the tread belt's surface. In some cases, the compressive force is applied at a single location such as along an edge of the tread belt. In other examples, the compressive force is applied to the tread belt at multiple locations such as along the edge and in regions that are centrally located to the tread belt.

In another example, the locking mechanism applies a force that has at least a vector component that is aligned with the plane of the surface's area or protrudes through an orifice in the tread belt. This may be accomplished by applying a pin, pins, or another type of object through the tread belt and thereby preventing the movement of the tread belt. In at least one of these types of examples, an opening may be defined in the surface of the tread belt. A retractable pin may be connected to the deck, and an inserting mechanism may be used to insert the retractable pin into the opening when the locking mechanism is active. The inserting force may be a magnetic force, a hydraulic force, a pneumatic force, a spring force, a mechanical force, another type of force, or combinations thereof.

An embodiment that includes a pin being inserted into an opening of the tread belt is not feasible for slowing down a tread belt because the tread belt's momentum would be immediately arrested upon the insertion of the pin into the opening. The immediate stopping of the tread belt would result in high loads on the tread belt and the pin, which would likely to result in damage. Thus, the locking mechanism is advantageous because the locking mechanism may not have to arrest momentum of the tread belt when locking the tread belt in place.

In another example, a clamp is positioned adjacent to one of the deck pulleys or a component that moves with the pulleys such as the axle supporting the pulley. The clamp may apply a compressive force on the pulley and/or on associated component to lock the tread belt in place. In other examples, the pulley, axle, or other component includes an opening or a flat that can interlock with a component of the locking mechanism to lock the tread belt in place. As with the openings described above, interlocking a component of the locking mechanism with the pulley or associated component may not be feasible when the momentum of the tread belt has to be arrested when locking the tread belt in place.

In another example, a magnetic unit may be applied to at least one of the pulleys, the axle supporting the pulleys, a flywheel in communication with the pulleys, another component that moves with the pulleys, or combinations thereof. The magnetic unit may be used to apply a magnetic force strong enough to ensure that the tread belt cannot move. In one particular example, a flywheel stores the inertia of a user powered tread belt, and a magnetic unit prevents the moving of the tread belt by imposing a magnetic force on the flywheel.

The locking mechanism may be applied in response to any appropriate trigger. In some examples, the locking mechanism is applied in response to the user activating the locking mechanism. This may be accomplished with an input mechanism incorporated into the treadmill or another device in communication with the treadmill. For example, the input mechanism may be a push button, a touch screen, a microphone, a lever, a switch, a dial, another type of input mechanism, or combinations thereof. In other examples, the input mechanism may include manually inserting a pin, manually inserting an interlocking component, or manually applying a compressive force.

In examples where the treadmill is configured to support an anaerobic exercise, the locking mechanism may be triggered in response to the movement of a component associated with the anaerobic exercise. In one example, the locking mechanism is triggered in response to movement of a pull cable, in response to a rotation of a flywheel of a resistance mechanism, a movable weight is lifted, an increased force is applied to the deck (e.g. indicting the acceleration of a free weight or other type of lift exercise), another trigger, or combinations thereof. In some cases, the locking mechanism locks the tread belt from moving when the pull cable is being pulled. In some cases, the locking mechanism locks the tread belt in response to a pull force on the pull cable.

In another example, the locking mechanism is triggered in the absence of a force. For example, the locking mechanism may prevent the tread belt from moving when the motor is inactive.

In some examples, an upright structure is connected to the base. In this example, the upright structure includes a first arm and a second arm extending away from a central portion of the upright structure. The first arm supports a first cable, and the second arm supports a second cable. The first and second cables each have an end that is attached to a handle. The other end of the first and second cables are attached to a resistance mechanism that is connected to the upright structure. A display is also attached to the upright structure which displays information about the user's workout involving the movement of the tread belt. In this example, the resistance mechanism includes a flywheel, and the rotation of the flywheel is resisted with a magnetic unit.

The spool may be connected to the axle so that the axle moves when the spool rotates in a first direction with the pulling force on the cable. As the user reduces the pull force, a counterweight or another type of winding mechanism may cause the spool to rotate in a second direction to wind the pull cable back around the spool. In the depicted example, the spool is connected to the axle so that when the spool rotates in a second direction, the axle does not rotate with the spool. Thus, in the second direction, the spool rotates independent of the axle. Thus, when the pull cable moves along its length in the second direction, the flywheel does not rotate with the pull cable.

With the flywheel rotating in a single direction, the determination of multiple parameters of the user's workout can be simplified. For example, a sensor positioned adjacent to the flywheel may detect the movement of the flywheel by counting the number of rotations or partial rotations of the flywheel. Counting may be accomplished in examples where the magnet, marker, ticker, or other indicator passes by the sensor. Each repetition of a pull exercise may correspond to a predetermined number of counts. Thus, the repetitions may be tracked by the rotation of the flywheel. Further, the time duration between the counts may also indicate the speed at which the user is pulling on the pull cable, which can correspond to the force that the user is applying to the pull exercise. The force can also be determined by factoring in the resistance level that the magnetic unit is applying to the flywheel.

While this example has been described with reference to the flywheel rotating in just a single direction, in alternative embodiments, the flywheel rotates with the movement of the pull cable in both directions.

In some examples, the magnetic unit is positioned adjacent to a periphery of the flywheel. The magnetic unit may impose a magnetic force on the flywheel that resists the flywheel's rotation. In some cases, the strength of the magnetic unit's resistance may be increased by moving the magnetic unit closer to the flywheel. Conversely, in the same example, the strength of the resistance may be lowered by moving the magnetic unit farther away from the flywheel. In an alternative example, the strength of the magnetic unit may be altered by changing an electrical power level to the magnetic unit. Also disposed on the axle is a spool where the second end of the pull cable connects to the resistance mechanism. As the pull cable is pulled from the first end, the second end of the cable moves causing the spool to rotate.

The treadmill may include a display. The display may be incorporated into a console of the treadmill, into an upright portion of the treadmill, into the deck of the treadmill, into a rail of the treadmill, into another portion of the treadmill, into a device in electronic communication with the treadmill, or combinations thereof. In this example, the display may have fields for presenting a number of pull cable sets, a number of pull cable repetitions, an average pull force on the cable, a resistance level, an anaerobic calorie burn, an aerobic calorie burn, a heart current rate, a running time duration, respiratory rate, a blood pressure rate, another type of physiological parameter, another type of treadmill operational type of parameter, or combinations thereof. Thus, the display may depict exercise parameters from exercises involving the movement of the tread belt and exercises involving movement of another component independent of the tread belt's movement. The display may depict exercise parameters from exercises involving the movements of aerobic exercises and anaerobic exercises. Further, the display may present physiological information that is independently derived from the movement of the tread belt and exercises involving movement of another component independent of the tread belt's movement and/or independently from exercises involving the movements of aerobic exercises and anaerobic exercises. In other examples, the physiological parameters are derived from a combination of different exercise types.

The display of the current disclosure may display a wide range of information that is not found in conventional treadmills, which provide an option of performing just aerobic type exercises. In some examples, the display includes information from the aerobic segments of the workout as well as information relating to anaerobic portions of the workout.

In this example, the treadmill may track the user's number of calories burned. The inputs for the calorie burn may be obtained from the aerobic segments of the workout such as the time duration of an aerobic workout, the heart rate of the user, the speed of the treadmill, the user's weight, other parameters of the aerobic workout, or combinations thereof. Further, the presented calorie burn may be based in part on the anaerobic segments of the workout such as the amount of weight lifted by the user, the number of sets and repetitions performed by the user, the force at which the user executed the pull, the heart rate before and after the pull, the time duration between performing the pull and completing an aerobic portion of the workout, other factors, or combinations thereof. The factors from both the aerobic and anaerobic portions of the workout may be collectively used to determine the user's calorie burn.

Further, the physiological parameters of the user may be tracked during both the aerobic portions and the anaerobic portions of the workout. Conventionally, a treadmill tracks just the physiological parameters during the aerobic portion of the workout. As a result, the user is unaware if the user is exceeding a desired heart range, a blood pressure range, a respiratory rate range, another type of physiological condition range during the anaerobic portions of the workout. With some of the principles described in the present disclosure, the user can monitor his or her health during additional portions of his or her workout.

In some examples, a handrail is connected to the upright structure. The handrail includes a first post connected to a first side, and a second post connected to a second side. Each of the first and second posts are pivotally connected to the upright structure.

The deck may be connected to the upright structure at a base pivot connection. As the deck is rotated upwards, the deck engages the handrail before arriving at the deck's storage position. As the deck continues to move upward after engaging the handrail, the posts of the handrail rotate about the post pivot connections. Thus, as the deck continues to move upward, the deck and the handrail move upward together. When the deck arrives at the storage position, a latch may be used to hold the deck in the storage position. Thus, the deck and the handrail are held in an upward, storage position with a single latch.

The handrail may be pivotally attached to the upright structure. In some cases, the handrail may pivot upward to a storage position so that the distal end of the handrail is at a higher elevation than an operating position of the handrail. The handrail may be pivoted upwards when the deck is rotated upwards into a storage position to minimize the footprint of the treadmill during periods of storage. In other examples, the handrail may pivot downward. In this scenario, the handrail may be pivoted downward so that the distal end of the handrail is at a lower elevation in the storage position than when the handrail is in the operational position. The handrail may provide the user additional support when the user is performing an exercise on the deck.

The handrail may include any appropriate shape. In some cases, the handrail includes a generally linear shape and the user can grasp the handrail conveniently when standing on the deck and facing the upright structure. In other example, the handrail may include a generally U-shape rod that positions holding regions of the handrail above the first and second sides of the deck. The first and second holding portions may be generally aligned with each other. In some examples, a user may exercise between the first holding region and the second holding region while standing on the deck. With the user positioned between the first holding region and the second holding region, the user may conveniently grasp the handrail regardless of whether the user is facing towards the upright structure or facing away from the upright structure.

While the examples above have described the handrail as being generally linear or generally U-shaped, the handrail may include any appropriate shape. For example, a non-exhaustive list of additional shapes that may be compatible for the handrail includes a generally triangular shape, a generally circular shape, a generally rectangular shape, a generally ovular shape, an asymmetric shape, another type of shape, or combinations thereof.

The different functions of the locking mechanism may be implemented with a processor and programmed instructions in memory. In some examples, certain aspects of the locking mechanism's functions are executed with a customized circuit. Additionally, the different functions of the exercise machine may be implemented with a processor and programmed instructions in memory. In some examples, the certain aspects of the exercise machine's functions are executed with a customized circuit.

The processors may include an intelligent hardware device, (e.g., a general-purpose processor, a digital signal processor (DSP), a central processing unit (CPU), a microcontroller, an application specific integrated circuit (ASIC), a field-programmable gate array (FPGA), a programmable logic device, a discrete gate or transistor logic component, a discrete hardware component, or any combination thereof). In some cases, the processors may be configured to operate a memory array using a memory controller. In other cases, a memory controller may be integrated into the processor. The processor may be configured to execute computer-readable instructions stored in a memory to perform various functions (e.g., function or tasks supporting overlaying exercise information on a remote display).

An I/O controller may manage input and output signals for the media system and/or the exercise machine. Input/output control components may also manage peripherals not integrated into these devices. In some cases, the input/output control component may represent a physical connection or port to an external peripheral. In some cases, I/O controller may utilize an operating system such as iOS®, ANDROID®, MS-DOS®, MS-WINDOWS®, OS/2®, UNIX®, LINUX®, or another known operating system.

Memory may include random access memory (RAM) and read only memory (ROM). The memory may store computer-readable, computer-executable software including instructions that, when executed, cause the processor to perform various functions described herein. In some cases, the memory can contain, among other things, a Basic Input-Output system (BIOS) which may control basic hardware and/or software operation such as the interaction with peripheral components or devices.

The treadmill may be in communication with a remote that stores and/or tracks fitness data about a user. An example of a program that may be compatible with the principles described herein includes the iFit program which is available through www.ifit.com. Such profile information may be available to the user through an iFit program available through www.ifit.com and administered through ICON Health and Fitness, Inc. located in Logan, Utah, U.S.A. An example of a program that may be compatible with the principles described in this disclosure is described in U.S. Pat. No. 7,980,996 issued to Paul Hickman. U.S. Pat. No. 7,980,996 is herein incorporated by reference for all that it discloses. In some examples, the user information accessible through the remote device includes the user's age, gender, body composition, height, weight, health conditions, other types of information, or combinations thereof. The user information may also be gathered through profile resources available through other types of programs. For example, the user's information may be gleaned from social media websites, blogs, public databases, private databases, other sources, or combinations thereof. In yet other examples, the user information may be accessible through the exercise machine. In such an example, the user may input the personal information into the exercise machine before, after, or during the workout. The user's information along with historical exercise data of the user may be used to provide the user with a range of physiological parameters that are healthy for the user. Further, this information may be used to make workout recommendations and derive user goals. Also, this type of information may be useful for presenting the user's progress.

It should be noted that the methods described above describe possible implementations, and that the operations and the steps may be rearranged or otherwise modified and that other implementations are possible. Furthermore, aspects from two or more of the methods may be combined.

Information and signals described herein may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and modules described in connection with the disclosure herein may be implemented or performed with a general-purpose processor, a DSP, an ASIC, a FPGA or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices (e.g., a combination of a digital signal processor (DSP) and a microprocessor, multiple microprocessors, one or more microprocessors in conjunction with a DSP core, or any other such configuration).

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope of the disclosure and appended claims. For example, due to the nature of software, functions described above can be implemented using software executed by a processor, hardware, firmware, hardwiring, or combinations of any of these. Features implementing functions may also be physically located at various positions, including being distributed such that portions of functions are implemented at different physical locations.

Computer-readable media includes both non-transitory computer storage media and communication media including any medium that facilitates transfer of a computer program from one place to another. A non-transitory storage medium may be any available medium that can be accessed by a general purpose or special purpose computer. By way of example, and not limitation, non-transitory computer-readable media can include RAM, ROM, electrically erasable programmable read only memory (EEPROM), compact disk (CD) ROM or other optical disk storage, magnetic disk storage or other magnetic storage devices, or any other non-transitory medium that can be used to carry or store desired program code means in the form of instructions or data structures and that can be accessed by a general-purpose or special-purpose computer, or a general-purpose or special-purpose processor. Also, any connection is properly termed a computer-readable medium. In some cases, the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, digital subscriber line (DSL), or wireless technologies such as infrared, radio, and microwave are included in the definition of medium. A portable medium, as used herein, include CD, laser disc, optical disc, digital versatile disc (DVD), floppy disk and Blu-ray disc where disks usually reproduce data magnetically, while discs reproduce data optically with lasers. Combinations of the above are also included within the scope of computer-readable media.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples described herein, but is to be accorded the broadest scope consistent with the principles and novel features disclosed herein.

What is claimed is:

1. A treadmill comprising:

a deck;

a first pulley disposed in a first portion of the deck;

a second pulley disposed in a second portion of the deck;

a tread belt surrounding the first pulley and the second pulley; and a locking mechanism configured to selectively lock the tread belt from moving in response to movement of an anaerobic exercise component.

2. The treadmill of claim 1, wherein:

the anaerobic exercise component comprises a pull cable and a resistance mechanism incorporated into the treadmill, a first end of the pull cable configured to have a handle connected thereto, a second end of the pull cable connected to the resistance mechanism, the pull cable configured to unwind from a spool when pulled and to wind back around the spool when released, the resistance mechanism configured to selectively apply a resistance to the pull cable when pulled;

the treadmill further comprises an upright structure connected to the deck; and the pull cable is incorporated into the upright structure.

3. The treadmill of claim 2, wherein:

the resistance mechanism includes a magnetic unit and a flywheel;

the flywheel is incorporated into the upright structure; and the magnetic unit is configured to selectively apply the resistance to a rotation of the flywheel.

4. The treadmill of claim 3, further comprising a sensor that detects movement of the flywheel.

5. The treadmill of claim 4, wherein the sensor is configured to be in electronic communication with the locking mechanism.

6. The treadmill of claim 2, wherein:

an input mechanism is incorporated into the upright structure; and the input mechanism is configured to control the locking mechanism.

7. The treadmill of claim 2, wherein selectively locking the tread belt from moving in response to movement of anaerobic exercise component comprises selectively locking the tread belt from moving in response to detecting a pull force on the pull cable.

8. The treadmill of claim 1, further comprising:

a processor; and a memory that includes programmed instructions to cause the locking mechanism to lock the tread belt from moving.

9. The treadmill of claim 1, wherein the locking mechanism is configured to apply a magnetic force to at least one of the first pulley and the second pulley to selectively lock the tread belt from moving.

10. The treadmill of claim 1, wherein the locking mechanism is configured to be electronically operated.

11. The treadmill of claim 1, wherein the locking mechanism is configured to be manually operated.

12. The treadmill of claim 1, wherein:

the treadmill further comprises a motor in mechanical communication with at least one of the first pulley and the second pulley;

the motor, when active, causes the tread belt to move; and the locking mechanism prevents the tread belt from moving when the motor is inactive.

13. A treadmill, comprising:

a deck;

a first pulley disposed in a first portion of the deck;

a second pulley disposed in a second portion of the deck;

a tread belt surrounding the first pulley and the second pulley;

an anaerobic exercise component incorporated into the treadmill;

a locking mechanism configured to selectively lock the tread belt from moving;

a processor;

a memory in electronic communication with the processor; and instructions stored in the memory and operable, when executed by the processor, to:

determine that the anaerobic exercise component is moved; and selectively lock a position of the tread belt in response to the determining that the anaerobic exercise component is moved.

14. The treadmill of claim 13, wherein the determining that the anaerobic exercise component is moved comprises sensing movement of a pull cable incorporated into the treadmill.

15. The treadmill of claim 13, wherein the determining that the anaerobic exercise component is moved comprises sensing movement of a resistance mechanism incorporated into the treadmill.

16. A treadmill, comprising:

a deck;

a first pulley disposed in a first portion of the deck;

a second pulley disposed in a second portion of the deck;

a tread belt surrounding the first pulley and the second pulley;

a motor in mechanical communication with at least one of the first pulley and the second pulley that, when active, causes the tread belt to move;

a locking mechanism configured to selectively lock the tread belt from moving;

an upright structure connected to the deck;

a pull cable incorporated into the upright structure, a first end of the pull cable configured to have a handle connected thereto;

a resistance mechanism connected to a second end of the pull cable, the resistance mechanism including a flywheel;

a magnetic unit that is configured to selectively apply a resistance to a rotation of the flywheel; and a sensor that is configured to detect movement of the flywheel, the sensor configured to be in electronic communication with the locking mechanism;

wherein the locking mechanism is configured to prevent movement of the tread belt in response to movement of the flywheel.

* * * * *